United States Patent [19]

Nakamura et al.

[11] Patent Number: 4,954,838

[45] Date of Patent: Sep. 4, 1990

[54] PHOTOSENSITIVE MATERIAL PROCESSING APPARATUS

[75] Inventors: Takashi Nakamura; Kaoru Uchiyama, both of Minami-ashigara, Japan

[73] Assignee: Fuji Photo Film Co., Ltd., Kanagawa, Japan

[21] Appl. No.: 328,261

[22] Filed: Mar. 24, 1989

[30] Foreign Application Priority Data

Apr. 11, 1988 [JP] Japan ..... 63-88554
Feb. 21, 1989 [JP] Japan ..... 1-41172

[51] Int. Cl.[5] ..... G03D 3/08
[52] U.S. Cl. ..... 354/320; 354/331
[58] Field of Search ..... 354/307, 312, 313, 314, 354/316, 320, 321, 322, 331

[56] References Cited

U.S. PATENT DOCUMENTS 3,690,758 9/1972 Knechtel et al. ..... 354/331
4,099,194 7/1978 Kummerl ..... 354/321
4,164,371 8/1979 Viehrig et al. ..... 354/312
4,794,415 12/1988 Larsen ..... 354/320

FOREIGN PATENT DOCUMENTS 1495745 12/1977 United Kingdom ..... 354/331

*Primary Examiner*—A. A. Mathews
*Attorney, Agent, or Firm*—Sughrue, Mion, Zinn, Macpeak & Seas

[57] ABSTRACT

A photosensitive material processing apparatus adaptable for occasional operation is provided, comprising a processing tank filled with processing solution and an adjustable closure for controlling access to the tank through its top opening. The adjustable closure includes a fixed lid, a movable lid, and a drive for the movable lid. The operating openness, which is the surface area of the solution open to the ambient atmosphere divided by the volume of the solution, is set in a specific range and the quiescent openness is up to 70% of the operating openness.

7 Claims, 6 Drawing Sheets

PHOTOSENSITIVE MATERIAL PROCESSING APPARATUS

FIELD OF THE INVENTION

This invention relates to an apparatus for processing photosensitive material, and more particularly, to an apparatus for the wet processing such as wet development and bleach-fixing of photosensitive material.

BACKGROUND OF THE INVENTION

In general, wet processing of photosensitive material is carried out by dipping the material for a predetermined time in a processing solution such as a developing solution, a bleach-fix solution, and washing water in a processing tank.

The state-of-the-art for the continuous processing of photosensitive material in such a processing bath has a problem that the processing solution evaporates, lowers its temperature or undergoes deterioration or other various changes through oxidation or the like because its surface is open to the ambient atmosphere. As the processing solution evaporates, a difference arises in concentration between the solution near the surface and the solution near the tank bottom, which is undesirable for even development. An extra amount of processing solution or diluent must be fed to make up for such an additional loss of processing solution in the tank. In addition, evaporated processing solution will undesirably deposit on various parts of the processing apparatus, particularly on feed rollers for carrying photosensitive material. Such deposits later dry to present a tacky surface or cause staining. It is apparent that changes of properties or deterioration of processing solution adversely affects development. Further the developing solution, for example, must be maintained at a temperature of about 20° to 50° C. in order to ensure proper development. If a noticeable amount of heat dissipates from the solution surface, an excess amount of heat must be applied to maintain the solution at the optimum temperature.

One solution to prevent evaporation of processing solution is a lid provided in the processing tank near the solution surface to cover the solution surface. However, if the solution surface is entirely covered with the lid, the lid must be removed whenever photosensitive material is carried into the processing tank. Such removal of the lid for every operation is cumbersome. It might occur to the skilled artisan to provide the lid with an opening through which photosensitive material can be carried into the processing tank. Since a part of the lid is always open independent of whether or not the tank is in operation, the processing solution still undergoes evaporation, temperature lowering, deterioration and property changes to some extent, though to a less extent than in the lidless tank.

A variety of processing apparatus are used in such wet processing of photosensitive material. The above-mentioned problems of processing solution including deterioration with time are rather less serious in automatic developing machines for commercial service among others because a large quantity of photosensitive material is daily processed and a corresponding large quantity of processing solution is replenished so that the processing solution in the tank is replaced over relatively a few cycles.

As opposed to such business use machines, wet color copying machines for consumers use, which have marked a rapid advance in these years, expect occasional operation or low utilization. The occasional operation or low utilization operation used herein means that the processor is operated at a few frequency or for a short time as exemplified by an operating efficiency of up to 1/10 round a day (one round represents the amount of film processed until the amount of replenisher added reaches the same as the processing solution originally in the tank) or up to 10% of the process temperature time as described in several manuals, for example, "Fuji Film Processing Manual, CR-56 Processing 163AL004B, General 12/87-KW05-2(1)," pages 73–74 and "Kodak R-3/R-3000 Chemicals CAT 123/5753" (1985), pages 41–42.

The apparatus of this type is generally designed such that a small quantity of processing solution is replenished for every operation. For example, 23 c.c. of developing solution is made up on processing of an A4-size sheet of photosensitive material. In such occasional operation, it takes a long time until the entire quantity of processing solution in the tank is replaced by a fresh solution or replenisher. Then the processing solution in the tank is deleteriously affected by aging.

In consideration of processing solution aging, it is conceivable to periodically replace the processing solution in the tank independent of the quantity of photosensitive material processed thus far. This idea is unacceptable for consumer use processing apparatus because the user has to perform cumbersome operation of replacing processing solution. In addition, the quantity of processing solution consumed is undesirably increased.

It is also conceivable to make up a somewhat excess amount of replenisher to compensate for deterioration of the processing solution. The replenishing amount must be precisely adjusted because an excess or short amount will more or less affect photographic performance. Such fine adjustment is difficult for ordinary users. Further, not only the quantity of replenishing solution used is increased, but the frequency of cumbersome replenishment operation is also increased.

SUMMARY OF THE INVENTION

A primary object of the present invention is to provide a novel and improved photosensitive material processing apparatus which can prevent evaporation, temperature lowering, deterioration and property changes of processing solution.

According to a first aspect of the present invention, there is provided a photosensitive material processing apparatus adaptable for occasional operation, comprising a processing tank which has an opening at the top and is filled with processing solution, and means for controlling access to the processing tank through its opening. Provided that V is the volume of the processing solution in the tank and S is the area of a portion of the processing solution surface which is open to the ambient atmosphere, the openness S/V during photosensitive material processing periods (to be referred to as operating openness, hereinafter) is in the range of from $1\times10^{-4}$ to $1\times10^{-1}$/cm and the openness S/V during quiescent periods (to be referred to as quiescent openness, hereinafter) is up to 70% of the operating openness S/V.

According to a second aspect of the present invention, there is provided an apparatus adaptable for the occasional processing of a photosensitive material by dipping it in processing solution, comprising a processing tank which has an opening at the top and is filled with the processing solution, a fixed lid attached to the tank opening and including an inlet and an outlet through which the photosensitive material can be delivered into and out of the tank and hence the processing solution, a movable lid mounted for relative motion to the fixed lid to open and close the inlet and outlet, and drive means for moving the movable lid.

According to a third aspect of the present invention, there is provided an apparatus for processing a photosensitive material by dipping it in processing solution, comprising a processing tank which has an opening at the top and is filled with the processing solution, a fixed lid attached to the tank opening and including an inlet and an outlet through which the photosensitive material can be delivered into and out of the tank and hence the processing solution, a movable lid mounted for relative motion to the fixed lid to open and close the inlet and outlet, drive means for moving the movable lid, and means disposed between the fixed and movable lids for preventing the movable lid from sticking to the fixed lid. Preferably, this apparatus is adaptable for occasional operation.

In one preferred embodiment, the drive means operates such that the inlet and the outlet are opened when the photosensitive material is carried into and out of the tank and the inlet and the outlet are closed during quiescent periods.

In one preferred embodiment, the anti-stick means comprises a plurality of ribs on at least one of directly faced surfaces of the fixed and movable lids. In another preferred embodiment, the anti-stick means comprises a roller rotatably supported in at least one of directly faced surfaces of the fixed and movable lids.

BRIEF DESCRIPTION OF THE DRAWINGS

The above and other objects, features, and advantages of the present invention will be better understood from the following description of preferred embodiments taken in conjunction with the accompanying drawings, in which.

DESCRIPTION OF THE PREFERRED EMBODIMENTS

Figure 1:
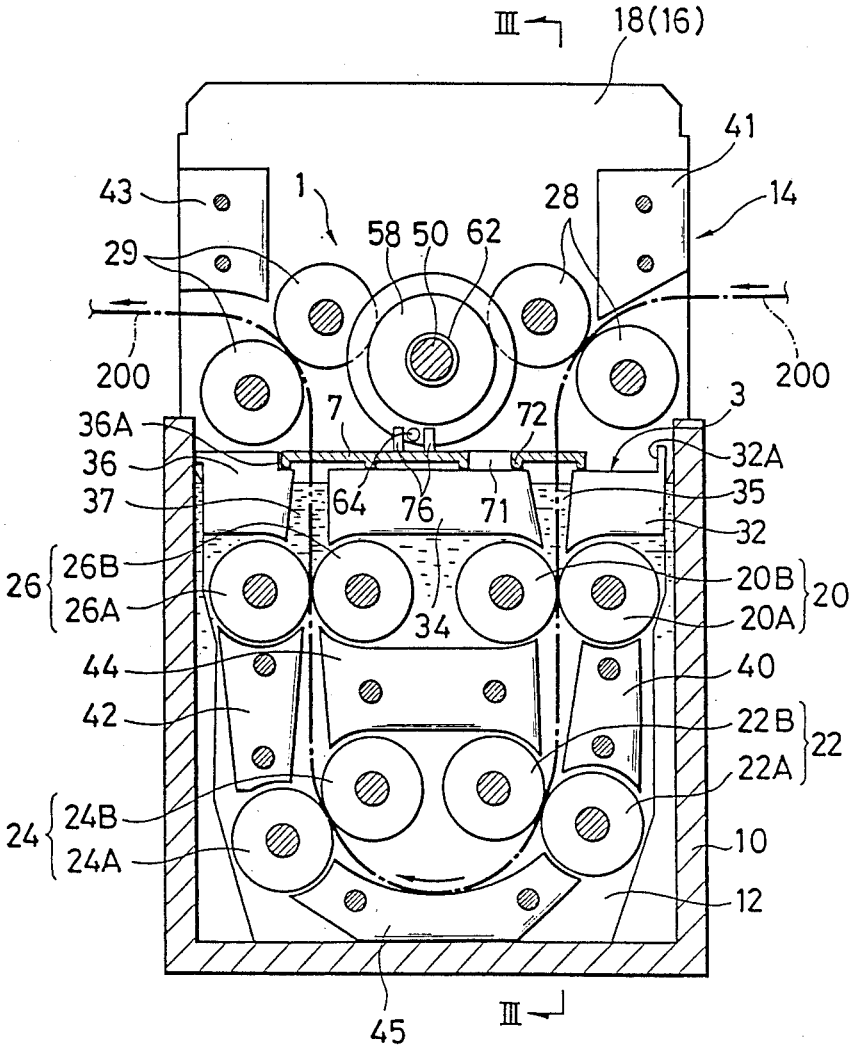
FIG. 1 is a partially cross-sectional, schematic side elevation of a photosensitive material processing apparatus according to one preferred embodiment of the present invention.

Referring to FIG. 1, there is illustrated a photosensitive material processing apparatus according to one preferred embodiment of the present invention. The apparatus of this embodiment is intended for use in development or bleach-fixing of photosensitive material. Of course, the apparatus of the present invention is not limited to such applications.

The apparatus is illustrated as comprising a processing tank 10 generally of a rectangular box shape having an opening at the top. The tank 10 is filled with a processing solution 12, for example, developing solution or bleach-fix solution to a predetermined level. The apparatus includes a rack assembly 14 which is received in the tank such that about a lower half of the rack assembly 14 is immersed in the solution 12.

A solution surface shutter assembly generally designated at 1 which comprises a fixed lid, a movable lid, and a drive as will be later described in detail is mounted to the rack assembly 14 in proximity to and slightly above the solution surface.

Figure 2:
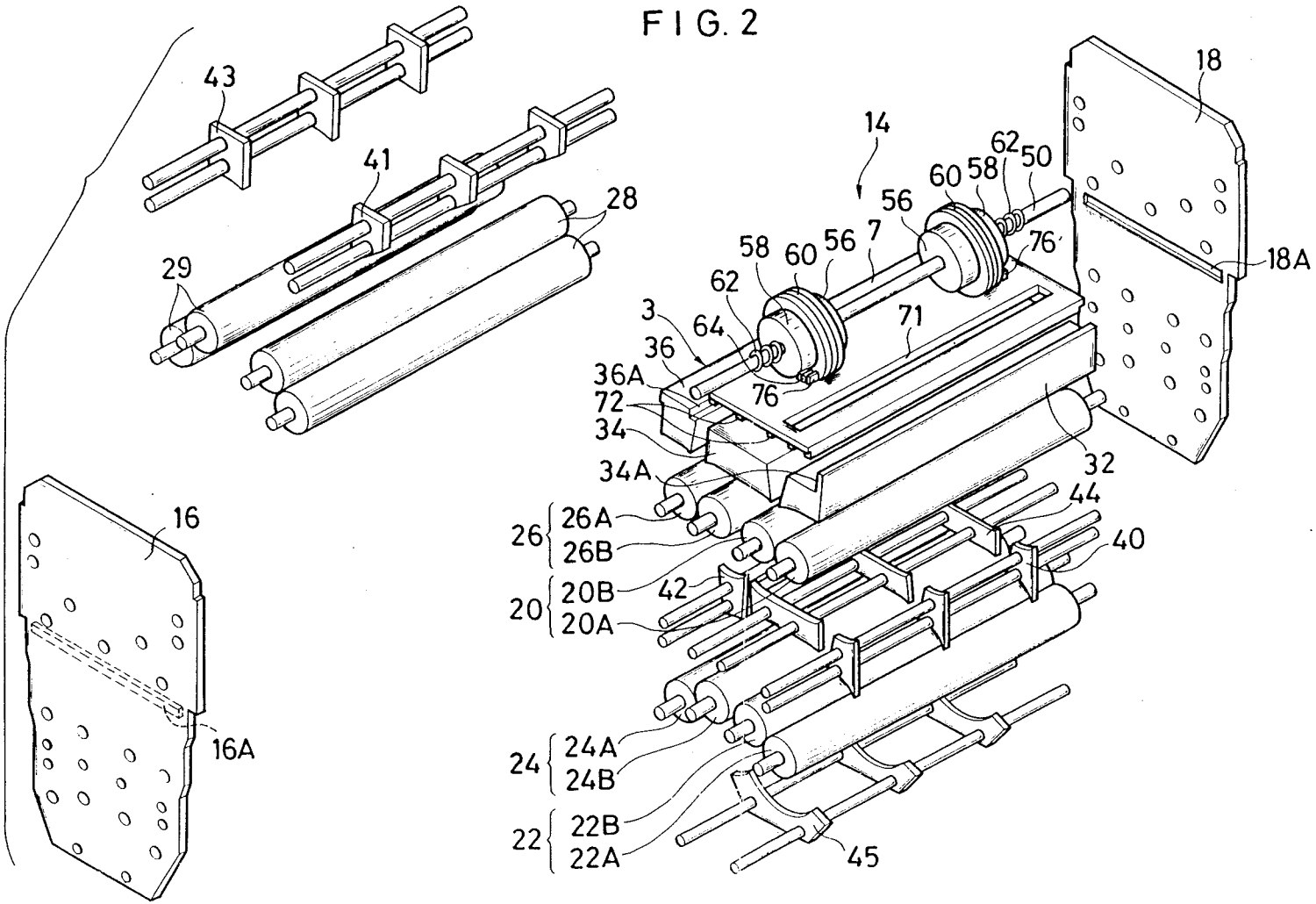
FIG. 2 is a perspective exploded view showing the rack assembly mounted in the tank of FIG. 1.

The rack assembly 14 includes a pair of side plates 16 and 18 as shown in FIG. 2. The side plates 16 and 18 are supported in parallel relationship by stays (not shown) fixedly secured to corresponding four corners of the plates. For brevity of description, the direction extending between and perpendicular to the side plates 16 and 18 is often designated a longitudinal direction of a member extending therebetween while the direction parallel to the surface of the side plates is designated a transverse direction.

Four pairs of transversely juxtaposed feed rollers 20, 22, 24, and 26 longitudinally extend between the side plates 16 and 18 at a lower portion thereof where the rollers are immersed in the processing solution 12. The rollers in each pair are in frictional contact so that rotation of rollers can convey a sheet therebetween. Additional two pairs of transversely juxtaposed feed rollers 28 and 29 longitudinally extend between the side plates 16 and 18 at an upper portion thereof where the rollers are positioned above the processing solution. The two pairs of feed rollers 28 and 29 are located at inlet and outlet sides for the photosensitive material, respectively. Guides 41 and 43 are disposed above the two pairs of feed rollers 28 and 29, respectively.

A fixed lid 3 is mounted to the top opening of the tank in proximity to the solution surface. In this embodiment, the fixed lid 3 includes transversely spaced-apart three segments 32, 34 and 36. The lid segment 32 is disposed above outside roller 20A of the feed roller pair 20 and in proximity to the solution surface and longitudinally extends between the side plates 16 and 18. The lid center segment 34 is disposed above inside rollers 20B and 26B of the feed roller pairs 20 and 26 and in proximity to the solution surface and longitudinally extends between the side plates 16 and 18. The lid segments 32 and 34 define therebetween an inlet 35 through which a usually sheet-like photosensitive material 200 is carried into the tank. The lid segment 36 is disposed above outside roller 26A of the feed roller pair 26 and in proximity to the solution surface and longitudinally extends between the side plates 16 and 18. The lid segments 36 and 34 define therebetween an outlet 37 through which the sheet 200 is carried out of the tank.

The material of which the lid segments are made may preferably have rigidity, durability, and chemical resistance to the processing solution 12 (free of swell, deformation, distortion, crack, and weakening by the action of processing solution). The material which will be dissolved into processing solution to detract from its photographic properties should be avoided. Preferred examples of the material of the lid include resins, for example, acrylic resin, vinyl chloride resin, polyamide, polyacetal, polycarbonate, poly(butylene terephthalate), polyphenylene ether, poly(ethylene terephthalate), high density polyethylene, polysulfone, polyether sulfone, polyphenylene sulfide, polyacrylate, polyamide imide, polyether imide, etc., rubbers such as synthetic and natural rubbers, ceramics such as alumina, metals such as stainless steel, titanium and titanium alloys, Hastelloy, etc., and a mixture thereof.

Guides 40 and 42 are disposed between outside rollers 20A and 22A and between outside rollers 26A and 24A, respectively. A center guide 44 is disposed in a region surrounded by the inside rollers 20B, 22B, 24B and 26B. The guides 40 and 42 define with the center guide 44 a path along which the sheet 200 is conveyed. A bottom guide 45 is disposed in a region surrounded by the rollers 22A, 22B, 24A and 24B and the tank bottom wall for reversing the direction of feed, that is, turning the sheet 200 from downward to upward direction as it advances.

With this construction, the sheet 200 delivered to the apparatus is fed along the inlet guide 41 by a pair of clamping rollers 28, conveyed into the tank 10 and hence the processing solution 12 through the inlet 35, fed by the clamping rollers 20, moved down along the guides 40 and 44, and then turned upward by the bottom guide 45 past the feed rollers 22. After reversal, the sheet 200 is fed upward by the clamping feed rollers 24 and 26 along the guides 42 and 44, moved out of the processing solution 12 and hence the tank 10 through the outlet 37, and then delivered to a subsequent station by the feed rollers 29 along the outlet guide 43.

Above the fixed lid 3 is disposed a movable lid 7 which is a slotted plate in the illustrated embodiment. The movable lid 7 is slidably supported between the side plates 16 and 18. More particularly, longitudinally opposed edges of the movable lid 7 are engaged in transversely extending channels 16A and 18A in the side plates 16 and 18 so that the lid 7 is transversely slidable along the side plate channels 16A and 18A. The movable lid 7 is provided with a slot 71 which is disposed midway in a transverse direction and longitudinally extends to near the opposed edges of the lid 7. As viewed from top, the slot 71 has approximately the same shape as the inlet 35 defined between the fixed lid segments 32 and 34. It will be understood that the movable lid 7 may be made of the same or similar material as the fixed lid as described above.

Figure 3:
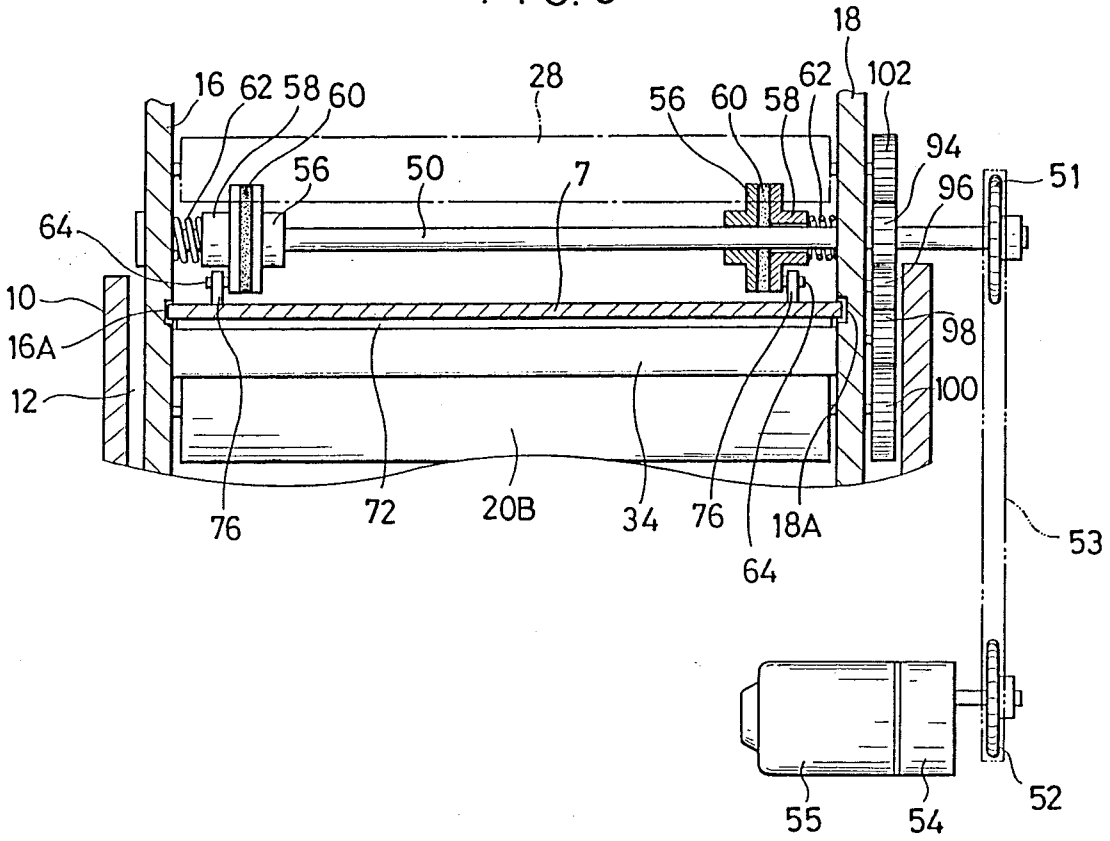
FIG. 3 is a cross section taken along lines III—III in FIG. 1.

Above the movable lid 7, a shaft 50 extends between the side plates 16 and 18 and is rotatably supported therebetween. As shown in FIG. 3, the shaft 50 at one end extends through the side plate 18 and projects beyond the side wall of the tank 10. To the projected end of the shaft 50 is attached an upper sprocket 51. A chain or belt 53 is trained around the upper sprocket 51 and a lower sprocket 52 which is attached to a drive shaft of a motor through a gear box 54. The drive force of the motor 55 is transmitted to the shaft 50 through the chain or belt 53.

On the shaft 50 is fixedly mounted a first gear 94 between the tank side wall and the side plate 18. The gear 94 is in mesh with a second gear 96 pivotably supported on the side plate 18, which is, in turn, in mesh with a third gear 98 also pivotably supported on the side plate 18. The third gear 98 is in mesh with fourth gears 100 which are fixedly secured to rotating shafts of the feed rollers 20B and 26B. This train of gears 94, 96, 98, and 100 transmits the drive force the shaft 50 receives to the feed rollers 20B and 26B.

The first gear 94 is also in mesh with a fifth gear 102 which is fixedly secured to a rotating shaft of one feed roller 28. This gear train transmits a drive force from the shaft 50 to the shaft of the feed roller 28 to rotate the feed rollers 28 to convey the sheet 20 in frictional engagement therebetween.

A pair of spaced apart bushes 56 are fixed secured to the shaft 50 as shown in FIGS. 2 and 3. These bushes 56 are disposed between the side plates 16 and 18 and have flanges facing the side plates 16 and 18, respectively. To the flange of each bush 56 is attached a frictional member 60. A movable bush 58 having a flange is movably mounted on the shaft 50 and mated with each fixed bush 56 so that the movable bush flange faces the fixed bush flange via the frictional member 60. A compressed coil spring 62 is disposed between each movable bush 58 and the corresponding side plate 16 or 18. The coil spring 62 forces the movable bush 58 against the fixed bush 56 via the frictional member 60.

To the flange of the movable bush 58 is anchored a pin 64 which extends toward the corresponding side plate 16 or 18. A pair of upright studs or followers 76 are anchored to the movable lid 7 to define therebetween a channel in which the pin 64 is engaged.

Figure 4:
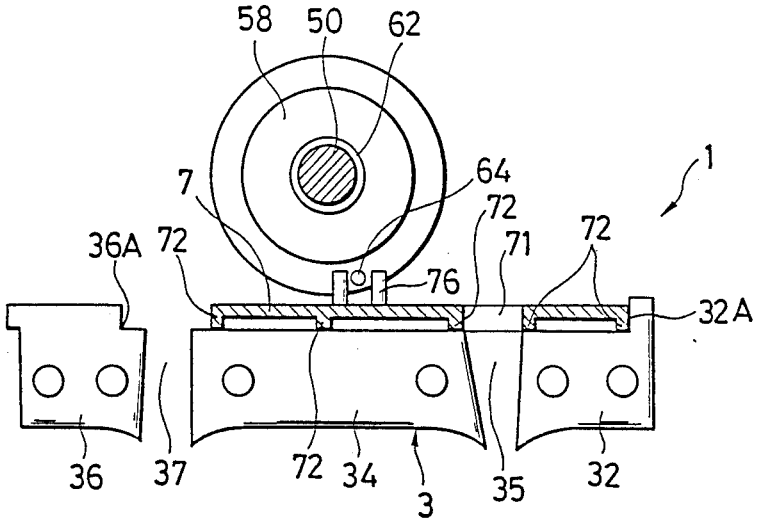
FIGS. 4, 5, and 6 illustrate in cross section different examples of the solution surface shutter assembly used in the photosensitive material processing apparatus of the present invention.

Thus, as viewed in FIG. 1, counter-clockwise rotation of the movable bush 58 is transmitted to the movable lid 7 through the slidable engagement between the pin 64 and the followers 76, moving the movable lid 7 to the right. When the movable lid 7 is moved a predetermined distance, it abuts a stop 32A formed on the fixed lid inlet segment 32 as shown in FIG. 4. At this point, the slot 71 in the movable lid 7 is in register with the inlet 35 between the fixed lid segments 32 and 34 and the left edge of the movable lid 7 is retracted away from the outlet 37 between the fixed lid segments 36 and 34. Thus both the inlet 35 and outlet 37 are opened so that the sheet 200 can be conveyed into and out of the tank 10.

If the movable bush 58 is rotated clockwise from the position shown in FIG. 4, the rotation is transmitted to the movable lid 7 through the slidable engagement between the pin 64 and the followers 76, moving the movable lid 7 to the left. When the movable lid 7 is moved the predetermined distance, it abuts another stop 36A formed on the fixed lid outlet segment 36 as shown in FIG. 1. At this point, the slot 71 in the movable lid 7 is above the fixed lid segment 34 and the right and left portions of the movable lid 7 are in register with the inlet and outlet 35 and 37 between the fixed lid segments 32, 34, 36. Thus both the inlet 35 and outlet 37 are closed.

The mechanism for transmitting the rotational force of the shaft 50 to the movable lid 7 is not limited to the above embodiment including fixed and movable bushes having a frictional member interposed therebetween. A choice may be made of a well-known clutch mechanism and a continuous urging mechanism using a bladed rotor, for example.

Now, the openness during processing and quiescent periods is described.

In the illustrated embodiment, the inlet 35 and the outlet 37 are open during periods of processing photosensitive material in the form of a sheet 200. Then the surface of the processing solution is open to the ambient atmosphere. More specifically, those solution surface areas within inlet 35 and outlet 37 are in contact with the ambient atmosphere. Since gaps often exist between the fixed lid segments 32, 34, 36 and the inside wall of the tank 10 as seen in FIG. 1, an overall area of solution surface exposed to the ambient atmosphere is the solution surface areas exposed in inlet 35 and outlet 37 plus the solution surface areas exposed in the gaps.

The overall area of solution surface exposed to the ambient atmosphere, that is, open area is now represented by S1 ($cm^2$) and the volume of processing solution 12 in the tank 10 is represented by V ($cm^3$). According to the first aspect of the present invention, the openness during processing (or operating openness) defined as the open area divided by the solution volume, K1=S1/V, is in the range of from $1\times10^{-4}$/cm to $1\times10^{-1}$/cm, preferably from $1\times10^{-3}$ to $1\times10^{-1}$/cm.

For design reasons, it is substantially difficult to set the operating openness K1 to less than $1\times10^{-4}$/cm. With an operating openness K1 of more than $1\times10^{-1}$/cm, the processing solution evaporates and/or deteriorates to a substantial extent during processing. Such evaporation and/or deterioration of the processing solution will sometimes result in a loss of photographic performance even in the case of frequent processing.

During quiescent periods when no photosensitive material is processed, the inlet 35 and the outlet 37 are closed so that the ambient atmosphere does not flow in or contact with the solution surface in inlet 35 and outlet 37. Thus the open area S2 during quiescent periods is equal to the solution surface areas exposed in the gaps as described above. The quiescent openness K2=S2/V is calculated from S2. This case is based on the assumption that the coverage of inlet 35 and outlet 37 by movable lid 7 is completely air tight.

If the coverage of inlet 35 and outlet 37 by movable lid 7 is incomplete or partial, or if the closed space has a relatively large volume, for example, as large as V/100 to V/10 irrespective of the air-tight coverage, or if a cover or similar member which either allows air flow or provides an air-tight seal to the tank encloses an upper portion of the apparatus, the open area S2 should be corrected for such coverage state or sealing degree.

For example, quiescent openness K2=S2/V may be determined as follows.

First, the degree of deterioration of a particular ingredient of processing solution is actually determined in a tank at room temperature. To this end, in the case of a developing solution, for example, the degree of deterioration may be determined by selecting an amine such as a hydroxylamine sulfate salt and diethylhydroxylamine or sodium sulfite from preservatives as the particular ingredient and carrying out chemical analysis on the particular ingredient to determine the loss of the ingredient. Separately, a model experiment is conducted using the same processing solution to determine a change of the degree of deterioration with a lapse of time (days) for various values of S/V. Then K2 may be obtained by comparing the actual data with the model relationship.

Nevertheless, since the inlet and the outlet are shielded against communication to the ambient atmosphere or against contact with air in the illustrated embodiment of the present invention, often the value calculated from geometrical dimensions may be used as quiescent openness K2 without a correction.

The same applies to any processing solutions other than the developing solution.

In the preferred embodiment of the present invention, quiescent openness K2=S2/V is set to 70% or lower of operating openness K1, preferably to 0.1 to 30%, most preferably to 0.5 to 10% of operating openness K1. If quiescent openness K2 is more than 70% of operating openness K1, evaporation and/or deterioration of the processing solution during quiescent periods increases to such an extent that some benefits of the present invention are lost.

If the photosensitive material processing apparatus is provided with a shutter assembly of a different structure from the solution surface shutter assembly 1 illustrated above or any other access control structure, operating and quiescent opennesses K1 and K2 may be suitably determined depending on the particular structure used. In any cases, K2/K1 should fall within the above-defined range.

Figure 5:
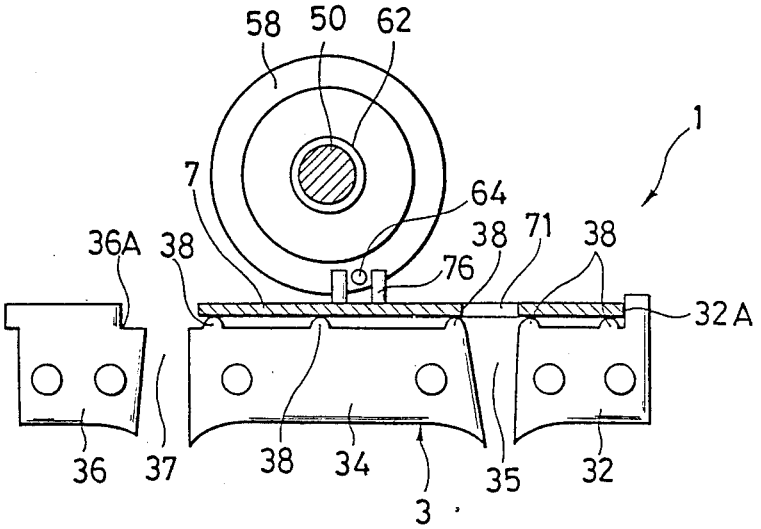
Figure 6:
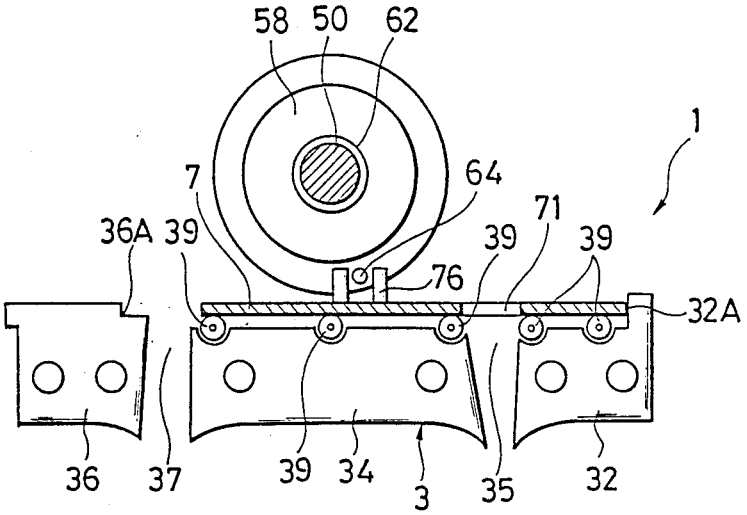

In a preferred embodiment of the invention, the apparatus is provided with anti-stick means disposed between the fixed and movable lids of the shutter assembly 1 for preventing the movable lid from sticking to the fixed lid. FIGS. 4, 5 and 6 illustrate several examples of the anti-stick means.

In the embodiment of FIG. 4, the anti-stick means includes a plurality of longitudinally extending ribs 72 formed on the surface of the movable lid 7 directly facing the fixed lid 3. The movable lid 7 is then in contact with the fixed lid 3 via the ribs 72. The ribs 72 play the role of spacers between the lids, ensuring smooth movement of the movable lid 7 along the fixed lid 3 because the ribs 72 prevent the lids from tightly clinging to each other to increase the sliding resistance even when processing solution spreads between the lids.

The spacing between the ribs 72 may be determined in consideration of the dimensions of the fixed lid segments 32, 34, and 36. More particularly, the ribs 72 are formed on the movable lid 7 at transverse opposite ends and at opposite edges of the slot 71 as shown in FIG. 4. Any additional ribs may be formed.

Although the ribs 72 extend in a longitudinal direction in the embodiment shown in FIG. 4, they may extend in a transverse direction, that is, the direction of movement of the movable lid 7. The ribs 72 may be either continuous or discontinuous strips. The ribs 72 may have any desired cross-sectional shape including rectangular, triangular, and semicircular shapes as long as smooth slide motion is ensured between the movable and fixed lids 7 and 3.

Further, the ribs 72 may be integrally formed with the movable lid 7 from the same material or they may be separate members bonded to the movable lid 7. In the latter case, the separate ribs 72 can be formed from an elastomer such as various rubbers and flexible resins so that the ribs may have sealing action.

Provision of such ribs is not limited to the movable lid 7 side. They may be formed on the fixed lid 3 or both the fixed and movable lids 3 and 7. In the embodiment shown in FIG. 5, the fixed lid segments 32 and 34 are provided with appropriately spaced ribs 38 on their surface facing the movable lid 7. More particularly, the ribs 38 are formed on the fixed lid segment 34 at transverse opposite ends and on the fixed lid segment 32 at transverse opposite ends as shown in FIG. 5. Any additional ribs may be formed. With respect to the function, shape, and material of the ribs 38, the same discussion as in the ribs 72 applies.

The ribs 72 or 38 fixedly provided on the movable lid 7 and/or fixed lid 3 are advantageous as the anti-stick means between the lids in that they are fully effective despite a simple structure although the anti-stick means is not limited to these embodiments.

FIG. 6 illustrates a further embodiment of the anti-stick means in which the fixed lid segments 32 and 34 are provided with appropriately spaced rollers 39 on their surface facing the movable lid 7. Provision of rollers 39 reduces the sliding resistance between the movable and fixed lids 7 and 3. The rollers 39 may be formed of elastomers such as various rubbers and flexible resins, various resins such as phenol resins, polyvinyl alcohol, polyethylene, and polyurethane, and metal materials such as stainless steel, titanium alloys, and Hastelloy.

It will be understood that such rollers may also be provided on the movable lid 7 or both the fixed and movable lids 3 and 7.

In the embodiments of the liquid surface shutter arrangement 1 shown in FIGS. 4 to 6, any surface-active agent or lubricant such as Teflon, silicone fluid or the like may be coated onto the sliding surface areas of the movable lid 7 or fixed lid 3, the contact areas of the tabs 72 or 38, or the surface of the rollers 39, if desired, for more smooth sliding movement between the lids 7 and 3.

Although provision of the tabs 72 or 38 or rollers 39 is described in the above embodiments, the means for preventing the movable lid 7 from clinging to the fixed lid 3 is not limited thereto in the practice of the present invention. For example, such anti-sticking purpose can be achieved simply by placing the fixed and movable lids in face-to-face relationship without forming any protrusions therebetween and properly treating the contact surface (one or both of the fixed and movable lids), for example, by coating a lubricant as described above.

It is to be noted that the apparatus of the present invention can perform well without the anti-stick means.

Desirably, the photosensitive material processing apparatus of the present invention is adaptable for occasional or low utilization operation.

The occasional operation used herein means that the photosensitive material is processed less frequently in the processor. The occasional operation may be defined as follows.

(1) When the photosensitive material is a negative film having a length of about 1.1 m, the average amount of film processed is up to 10 rolls a day.

(2) When the photosensitive material is copying photosensitive paper of A-4 size, the average amount of paper processed is up to 10 sheets a day. (3) When the photosensitive material is color paper, the average amount of paper processed is up to 2 square meter a day.

Another criterion for evaluating occasional operation is a replacement rate of the processing solution in the processor tank. For the purpose of maintaining satisfactory processability, the processor is usually designed such that an increment of replenisher (fresh solution) is added to the tank every time when the photosensitive material is processed or the processing solution in the tank is periodically replaced by a fresh solution. In this way, the used or exhausted processing solution is refreshed or replaced by a fresh solution. When the total amount of fresh solution replenished for a week is not more than the substantial volume of the tank which is equal to the volume V of processing solution, that is, one round, this processor operation is called occasional operation.

The apparatus of the present invention can accommodate such occasional operation as exemplified by a replacement rate of up to one round per 2 weeks, and even up to one round per month, and in an extreme case, up to one round per 2 months.

In the practice of the present invention, the amount of fresh solution replenished during operation may be in the ordinary range. The detail of occasional operation is described in the previously mentioned manuals.

Such occasional operation happens in consumer-oriented processors such as wet color copying machines and processors of relatively small size such as mini-laboratory processors rather than business-use processors such as standard laboratory processors.

In the case of a wet color copying machine, for example, a small increment of processing solution is replenished to the processing tank whenever an exposed photosensitive material sheet is processed as described above. In the case of occasional operation, only a small number of photosensitive sheets are processed and the replacement rate of processing solution is low. Thus it takes a long time until the entire volume of processing solution in the tank is replaced by fresh solution. For example, if five sheets of photosensitive material are daily processed in a processor which is designed such that 23 ml per photosensitive sheet of a processing solution (or fresh solution) is replenished to a processing tank having a substantial volume of 10 liters, then it takes more than 12 weeks until the entire volume of the processing solution (or mother solution) in the tank is replaced by the fresh solution.

The previously mentioned aging deterioration, especially oxidation and evaporation of the processing solution prevail under low replacement rate conditions. Then occasional replenishment of fresh solution is unsuccessful in maintaining optimum the processing solution in the tank. Irrespective of occasional operation, in order that actual copying operation can be instantaneously initiated to provide an acceptably short copying time, the processing solution is always maintained under pre-heated conditions at an optimum temperature (in the range of 35°–38° C. for developing solution. for example), tending to enhance deterioration and evaporation of the solution.

If the ability of processing solution for processing photosensitive material is considered preferential, water addition is sufficient to make up for evaporation, but as to deterioration, periodic replacement of processing solution in the tank (including exhausted solution discharge and fresh solution charge steps) is still required independent of the amount of photosensitive material which has been processed. However, such replacement is a cumbersome operation which is imposed on the user. In addition, the amount of processing solution consumed is increased, adding to the running cost.

From this point of view, the present invention which can control deterioration and evaporation of the processing solution is advantageous in that the processing solution in the tank can be maintained under optimum conditions despite low replacement rates and the periodic replacement of solution imposing a troublesome operation as described above is eliminated or at least reduced in frequency.

Provision of the anti-stick means between the movable and fixed lids is effective particularly for occasional operation. The occasional operation accompanies less frequent processing and thus less frequent movement of the movable lid relative to the fixed lid, leaving longer periods allowing the movable lid to tightly adhere to the fixed lid. For example, there is a chance that processing solution will be admitted between the movable and fixed lids. Such solution will later dry to leave deposits between the lids, which will increase the slide resistance of the movable lid. The anti-stick means between the movable and fixed lids always enables smooth movement of the movable lid and thus ensures smooth open/close operation of the inlet 35 and the outlet 37 even in the case of occasional operation.

In the context of this disclosure, the photosensitive material processing apparatus adaptable for occasional operation are not limited to those apparatus specialized for occasional operation and mainly intended for occasional operation, but include those apparatus which can accommodate for both occasional operation and another type of operation (for example, continuous operation, and moderate to large quantity operation), those apparatus which are of ordinary design with some modifications for occasional operation, and those apparatus whose manual does not exclude or prohibit occasional operation.

Examples of the photosensitive material processing apparatus adaptable for occasional operation include a variety of processors such as wet copying machines, automatic developing machines, printer processors, video printer processors, photographic print making coin vendors, color proof, and color paper processors.

The type of photosensitive material which can be processed by the apparatus of the invention is not particularly limited. Examples of such processable photosensitive material include a variety of photosensitive materials such as color negative films, color reversal films, color photographic paper, color positive films, color reversal photographic paper, processing photographic photosensitive materials, radiographic photosensitive materials, black-and-white negative films, black-and-white photographic paper, and micro-film photosensitive materials.

OPERATION

The operation of the photosensitive material processing apparatus according to the present invention is described below by referring to FIGS. 1 to 3 again.

During quiescent periods when no photosensitive material is supplied to processing tank 10, movable lid 7 is in abutment with stop 36A of fixed lid segment 36 as shown in FIG. 1. In this position, movable lid 7 blocks both inlet 35 and outlet 37 for photosensitive material. Thus fixed lid 3 (including segments 32, 34 and 36) and movable lid 7 in sealing engagement covers processing solution 12, effectively preventing evaporation, temperature drop, deterioration and changes thereof.

During operating periods when photosensitive material in the form of a photosensitive sheet 200 is to be processed in tank 10, sheet 200 is guided by guide 41 and conveyed downward by feed roller pair 28 into tank 10.

To this end, motor 55 (see FIG. 3) is actuated to rotate shaft 50 counterclockwise as viewed in FIG. 1 through sprockets 51, 52 and chain 53 and to rotate feed roller pair 28 through gears 94 and 102. Rotation of roller pair 28 conveys sheet 200 downward as described above. Rotation of shaft 50 is transmitted to movable bush 58 through fixed bush 56 and frictional disk 60. Rotation of movable bush 58 in turn forces tabs 76 on movable lid 7 via pin 64 to shift movable lid 7 to the right as viewed in FIG. 1. As a result of rightward shift of movable lid 7, the movable lid trailing edge clears outlet 37 and movable lid slot 71 comes in register with inlet 35 so that both inlet 35 and outlet 37 are open for passage of sheet 200.

After movable lid 7 has abutted against stop 32A on fixed lid segment 32, rotational force of shaft 50 is no longer transmitted because of sliding motion between movable bush 58 and frictional disk 60.

The rotational force of shaft 50 is also transmitted to feed rollers 20B and 26B for rotation thereof through gears 94, 96, 98, and 100. Thus photosensitive sheet 200 is introduced into processing solution 12 through inlet 35 and moved further downward by frictional engagement of rotating roller pair 20. Sheet 200 is passed between rollers 22, turned upward along bottom guide 45, and then moved upward by frictional engagement of rotating rollers 24 and 26. Thereafter, sheet 200 is moved outboard, that is, discharged out of processing solution 12 and past outlet 37, frictionally conveyed by rotating roller pair 29, and delivered to the subsequent station through guide 43.

While following this route, sheet 200 is processed with the solution in the tank 10.

Once sheet 200 has been delivered to the subsequent station, motor 55 is interrupted to stop rotation of all feed rollers. Then motor 55 is actuated again, but in the reverse direction to rotate shaft 50 clockwise as viewed in FIG. 1. Movable lid 7 is moved to the left in FIG. 1 until it abuts against stop 36A. At this position, movable lid 7 cooperates with fixed lid 3 in substantial seal contact to cover inlet 35 and outlet 37, shielding the solution from the ambient atmosphere.

In the practice of the present invention, processing tank 10 may be a single tank such as a developing tank, bleach-fixing tank or washing tank. Alternatively, a plurality of processing tanks similar to the above-illustrated tank 10 may be placed in series, for example, as serially disposed developing, bleach-fixing, and washing tanks. Then the photosensitive material can be successively passed through the tanks to carry out development, bleach-fix and washing on the material in this order. The photosensitive material processing apparatus in this embodiment involves three processing tanks and shutter assemblies associated therewith as defined in the present disclosure. A wet color copying machine as exemplified above typically has such an arrangement.

Although motor 55 is reversed to shift movable lid 7 to the left in FIG. 1 to block inlet 35 and outlet 37 in the above-illustrated embodiment, appropriate bias means typically in the form of a spring (not shown) may be provided to bias movable lid 7 to the left in FIG. 1 to block inlet 35 and outlet 37. In the latter case, a one-way clutch or similar disconnection mechanism must be disposed between shaft 50 and sprocket 51 so that reverse rotation of shaft 50 caused by the bias means is not transmitted to motor 55.

Although the same drive source, that is, motor 55 is used to synchronously perform transfer of photosensitive sheet 200 and open/close operation of solution surface shutter assembly 1 (or shift of movable lid 7) in the above-illustrated embodiment, different drive systems may be used in synchronization. The latter embodiment includes, for example, a first drive system for transferring photosensitive sheet 200 and a second drive system for operating solution surface shutter assembly 1. The second drive system may be a hydraulic actuator or step motor, for example. Detection means in the form of a sensor is used to detect transfer of sheet 200, and the second drive system is operated in response to the detection signal. Then solution surface shutter assembly 1 can be controlled in synchronization with transfer of sheet 200.

It is to be noted that the present invention is not limited to the synchronous mode of operation wherein opening of solution surface shutter assembly 1 is synchronized with transfer of photosensitive material as in the foregoing embodiments.

Although several preferred embodiments of the photosensitive material processing apparatus of the present invention are described with reference to the drawings, the present invention is not limited thereto.

EXAMPLES

EXAMPLE 1

Photosensitive material a which was a positive color photosensitive material (APC) was prepared as follows.

Preparation of photosensitive material a

A color photosensitive material was prepared from a paper support (100 μm thick) having both sides laminated with polyethylene by coating the support on the front side with 1st to 14th layers and on the back side with 15th to 16th layers as formulated below, on each side one on top of another. The polyethylene layer on the front side on which the 1st layer was directly coated contained 4 g/m$^2$ of titanium oxide as white pigment and a trace amount (0.003 g/m$^2$) of ultramarine as blue-tinting dye. The double laminated support on the surface had chromaticity coordinates of (88.0, −0.20, −0.75) in the (L*, a*, b*) system.

Photosensitive layer formulation

For each layer, ingredients and their amounts coated are shown below. The amount of each ingredient coated is expressed in gram per square meter (g/m$^2$) unit except that the amount of silver halide coated is expressed by calculating the amount of silver coated. The emulsion used in all the layers was prepared according to the preparation of emulsion EM-1 described later except that the emulsion used in the 14th layer is a Lippmann emulsion which had not been subject to surface chemical sensitization.

| Ingredients | g/m$^2$ |
|---|---|
| 1st layer: anti-halation layer | |
| Black colloid silver | 0.10 |
| Gelatin | 0.70 |
| 2nd layer: intermediate layer | |
| Gelatin | 0.70 |
| 3rd layer: low sensitivity red-sensitive layer | |
| Silver bromide spectrally sensitized with red sensitizing dyes ExS-1, ExS-2, and ExS-3, having average grain size 0.25 μm, size distribution (coefficient of variation) 8%, octahedral | 0.04 |
| Silver chlorobromide spectrally sensitized with red sensitizing dyes ExS-1, ExS-2, and ExS-3, having silver chloride 5 mol %, average grain size 0.40 μm, size distribution 10%, octahedral | 0.08 |
| Gelatin | 1.00 |
| Cyan coupler, ExC-1/ExC-2/ExC-3 = 1/1/0.2 in weight ratio | 0.30 |
| Anti-fading agent, Cpd-1/Cpd-2/Cpd-3/Cpd-4 = 1/1/1/1 in weight ratio | 0.18 |
| Anti-stain agent, Cpd-5 | 0.003 |
| Coupler dispersant, Cpd-6 | 0.03 |
| Coupler solvent, Solv-1/Solv-2/Solv-3 = 1/1/1 in weight ratio | 0.12 |
| 4th layer: high sensitivity red-sensitive layer | |
| Silver bromide spectrally sensitized with red sensitizing dyes ExS-1, ExS-2, and ExS-3, having average grain size 0.60 μm, size distribution 15%, octahedral | 0.14 |
| Gelatin | 1.00 |
| Cyan coupler, ExC-1/ExC-2/ExC-3 = 1/1/0.2 in weight ratio | 0.30 |
| Anti-fading agent, Cpd-1/Cpd-2/Cpd-3/Cpd-4 = 1/1/1/1 in weight ratio | 0.18 |

-continued

| Ingredients | g/m$^2$ |
|---|---|
| Coupler dispersant, Cpd-6 | 0.03 |
| Coupler solvent, Solv-1/Solv-2/Solv-3 = 1/1/1 in weight ratio | 0.12 |
| 5th layer: intermediate layer | |
| Gelatin | 1.00 |
| Anti-color-mixing agent, Cpd-7 | 0.08 |
| Anti-color-mixing agent solvent, Solv-4/Solv-5 = 1/1 in weight ratio | 0.16 |
| Polymer latex, Cpd-8 | 0.10 |
| 6th layer: low sensitivity green-sensitive layer | |
| Silver bromide spectrally sensitized with green sensitizing dye ExS-4, having average grain size 0.25 μm, size distribution 8%, octahedral | 0.04 |
| Silver chlorobromide spectrally sensitized with green sensitizing dye ExS-4, having silver chloride 5 mol %, average grain size 0.40 μm, size distribution 10%, octahedral | 0.06 |
| Gelatin | 0.80 |
| Magenta coupler, ExM-1/ExM-2 = 1/1 in weight ratio | 0.11 |
| Anti-fading agent, Cpd-9/Cpd-26 = 1/1 in weight ratio | 0.15 |
| Anti-stain agent, Cpd-10/Cpd-11/Cpd-12/Cpd-13 = 10/7/7/1 in weight ratio | 0.025 |
| Coupler dispersant, Cpd-6 | 0.05 |
| Coupler solvent, Solv-4/Solv-6 = 1/1 in weight ratio | 0.15 |
| 7th layer: high sensitivity green-sensitive layer | |
| Silver bromide spectrally sensitized with green sensitizing dye ExS-4, having average grain size 0.65 μm, size distribution 16%, octahedral | 0.10 |
| Gelatin | 0.80 |
| Magenta coupler, ExM-1/ExM-2/ExM-3 = 1/1/1 in weight ratio | 0.11 |
| Anti-fading agent, Cpd-9/Cpd-26 = 1/1 in weight ratio | 0.15 |
| Anti-stain agent, Cpd-10/Cpd-11/Cpd-12/Cpd-13 = 10/7/7/1 in weight ratio | 0.025 |
| Coupler dispersant, Cpd-6 | 0.05 |
| Coupler solvent, Solv-4/Solv-6 = 1/1 in weight ratio | 0.15 |
| 8th layer: intermediate layer | |
| same as the 5th layer | |
| 9th layer: yellow filter layer | |
| Yellow colloid silver, average grain size 100 Å | 0.12 |
| Gelatin | 0.07 |
| Anti-color-mixing agent, Cpd-7 | 0.03 |
| Anti-color-mixing agent solvent, Solv-4/Solv-5 = 1/1 in weight ratio | 0.10 |
| Polymer latex, Cpd-8 | 0.07 |
| 10th layer: intermediate layer | |
| same as the 5th layer | |
| 11th layer: low sensitivity blue-sensitive layer | |
| Silver bromide spectrally sensitized with blue sensitizing dyes ExS-5 and ExS-6, having average grain size 0.40 μm, size distribution 8%, octahedral | 0.07 |
| Silver chlorobromide spectrally sensitized with blue sensitizing dyes ExS-5 and ExS-6, having silver chloride 8 mol %, average grain size 0.60 μm, size distribution 11%, octahedral | 0.14 |
| Gelatin | 0.80 |
| Yellow coupler, ExY-1/ExY-2 = 1/1 in weight ratio | 0.35 |
| Anti-fading agent, Cpd-14 | 0.10 |
| Anti-stain agent, Cpd-5/Cpd-15 = 1/5 in weight ratio | 0.007 |
| Coupler dispersant, Cpd-6 | 0.05 |
| Coupler solvent, Solv-2 | 0.10 |
| 12th layer: high sensitivity blue-sensitive layer | |
| Silver bromide spectrally sensitized with blue sensitizing dyes ExS-5 and ExS-6, having average grain size 0.85 μm, size distribution 18%, octahedral | 0.15 |
| Gelatin | 0.60 |
| Yellow coupler, ExY-1/ExY-2 = 1/1 in weight ratio | 0.30 |
| Anti-fading agent, Cpd-14 | 0.10 |

-continued

| Ingredients | g/m² |
|---|---|
| Anti-stain agent, Cpd-5/Cpd-15 = 1/5 in weight ratio | 0.007 |
| Coupler dispersant, Cpd-6 | 0.05 |
| Coupler solvent, Solv-2 | 0.10 |
| 13th layer: UV-absorbing layer | |
| Gelatin | 1.00 |
| UV absorber, Cpd-2/Cpd-4/Cpd-16 = 1/1/1 in weight ratio | 0.50 |
| Anti-color-mixing agent, Cpd-7/Cpd-17 = 1/1 in weight ratio | 0.03 |
| Dispersant, Cpd-6 | 0.02 |
| UV absorber solvent, Solv-2/Solv-7 = 1/1 | 0.08 |
| Anti-irradiation dye, Cpd-18/Cpd-19/Cpd-20/Cpd-21/Cpd-27 = 10/10/13/15/20 in weight ratio | 0.05 |
| 14th layer: protective layer | |
| Fine grain silver chlorobromide having silver chloride 97 mol % and average grain size 0.1 μm | 0.03 |
| Acryl-modified copolymer of polyvinyl alcohol having molecular weight 50,000 | 0.01 |
| Granular polymethyl methacrylate (average grain size 2.4 μm)/silicon oxide (average grain size 5 μm) in equal amount | 0.05 |
| Gelatin | 1.80 |
| Gelatin hardener, H-1/H-2 = 1/1 in weight ratio | 0.18 |
| 15th layer: back layer | |
| Gelatin | 2.50 |
| UV absorber, Cpd-2/Cpd-4/Cpd-16 = 1/1/1 in weight ratio | 0.50 |
| Dye, Cpd-18/Cpd-19/Cpd-20/Cpd-21/Cpd-27 = 1/1/1/1/1 in weight ratio | 0.06 |
| 16th layer: back protective layer | |
| Granular polymethyl methacrylate (average grain size 2.4 μm)/silicon oxide (average grain size 5 μm) in equal amount | 0.05 |
| Gelatin | 2.00 |
| Gelatin hardener, H-1/H-2 = 1/1 in weight ratio | 0.14 |

Preparation of emulsion EM-1

Aqueous solutions of potassium bromide and silver nitrate were concurrently added to an aqueous gelatin solution at 75° C. over 15 minutes with vigorous stirring, obtaining octahedral silver bromide crystals having an average grain size of 0.35 μm. During preparation, 0.3 grams per mol of silver of 3,4-dimethyl-1,3-thiazoline-2-thione was added to the solution. To the emulsion were successively added 6 mg of sodium thiosulfate and 7 mg of chloroauric acid tetrahydrate, both per mole of silver. The emulsion was heated at 75° C. for 80 minutes for chemical sensitization. Further crystal growth was effected on the core of the thus obtained crystals under the same precipitation conditions as the first precipitation. Finally obtained was an octahedral monodispersed core/shell silver bromide emulsion having an average grain size of 0.7 μm. It had a coefficient of variation in grain size of about 10%. To the emulsion were added 1.5 mg of sodium thiosulfate and 1.5 mg of chloroauric acid tetrahydrate, both per mole of silver. The emulsion was again heated at 60° C. for 60 minutes for chemical sensitization, yielding an internal latent image type silver halide emulsion.

Each photosensitive layer further contained $10^{-3}$% by weight of ExZK-1 nucleating agent, $10^{-2}$% by weight of ExZK-2 nucleating agent, and $10^{-2}$% by weight of Cpd-22 nucleation promoter, based on the weight of silver halide. In each layer, there were additionally used Alkanol XC (manufactured by E.I. du-Pont) and sodium alkylbenzene sulfonate as emulsification/dispersion aids, and succinate ester and Magefac F-120 (manufactured by Dai-Nihon Ink K.K.) as coating aids. Stabilizers Cpd-23, Cpd-24 and Cpd-25 were used in those layers containing silver halide and colloid silver.

The compounds used in this example are identified below.

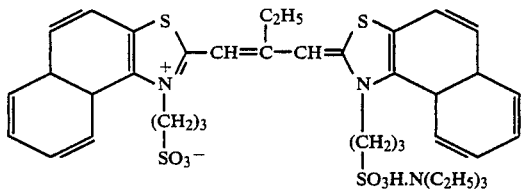

ExS-1

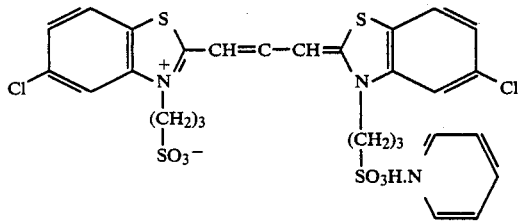

ExS-2

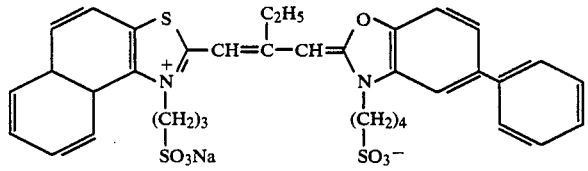

ExS-3

-continued
ExS-4
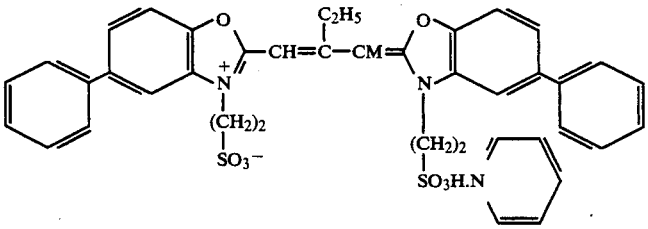
ExS-5
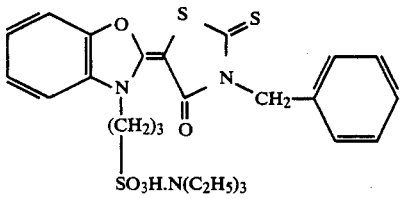
ExS-6
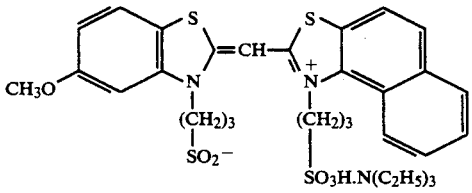
Cpd-1
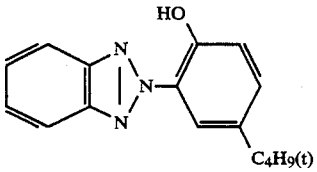
Cpd-2
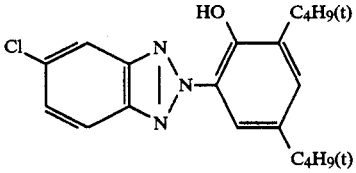
Cpd-3
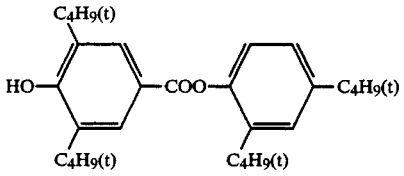
Cpd-4
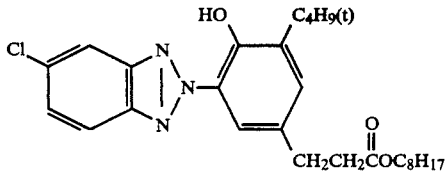
Cpd-5
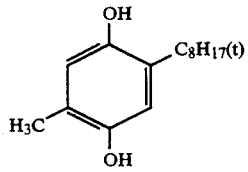
Cpd-6
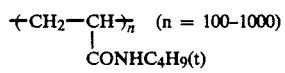

-continued
Cpd-7
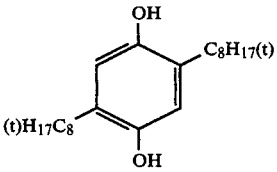
Cpd-8
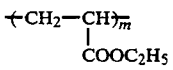
(m = 100–1000)
Cpd-9
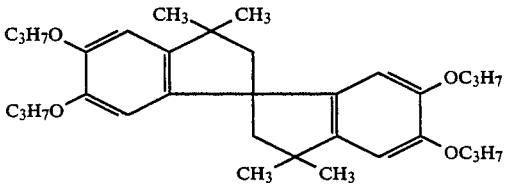
Cpd-10
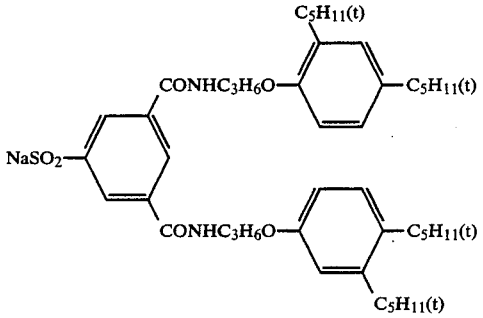
Cpd-11
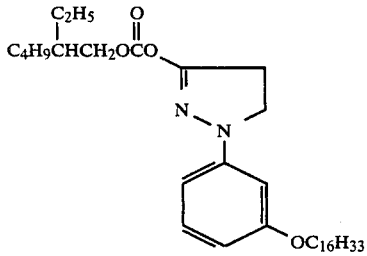
Cpd-12
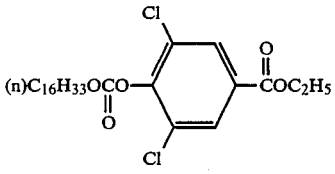
Cpd-13
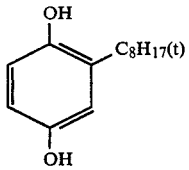
Cpd-14
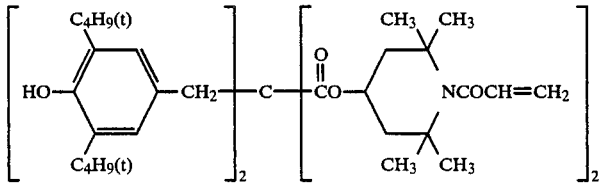

-continued
Cpd-15
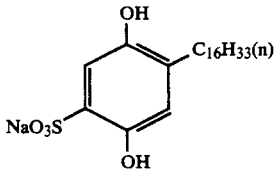
Cpd-16
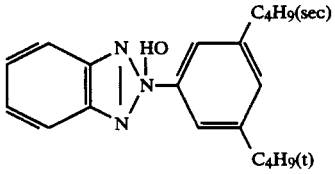
Cpd-17
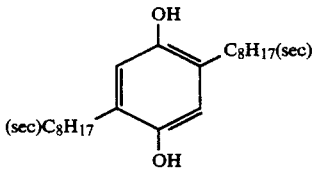
Cpd-18
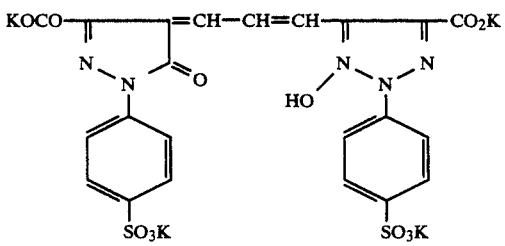
Cpd-19
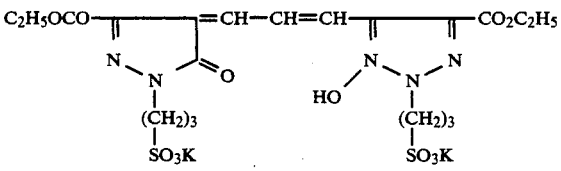
Cpd-20
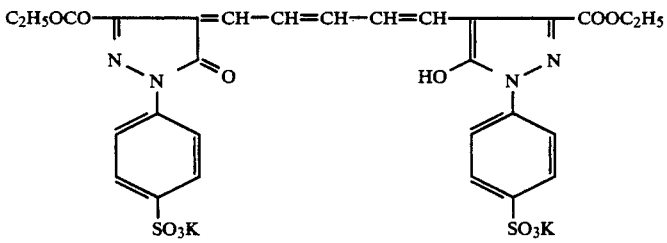
Cpd-21
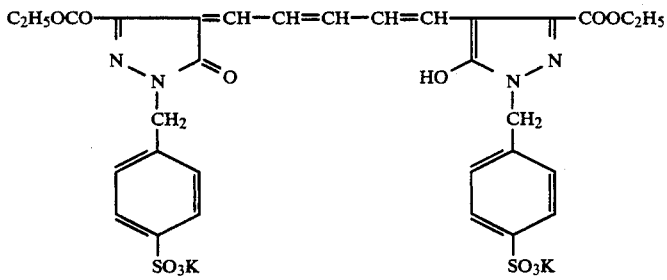
Cpd-22
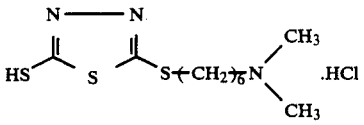

-continued
Cpd-23
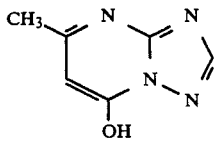
Cpd-24
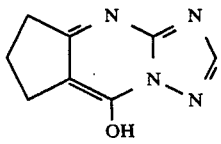
Cpd-25
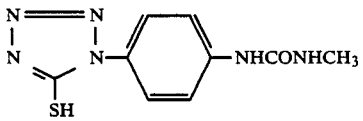
Cpd-26
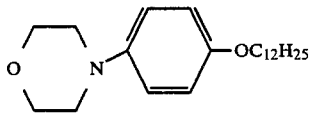
Cpd-27
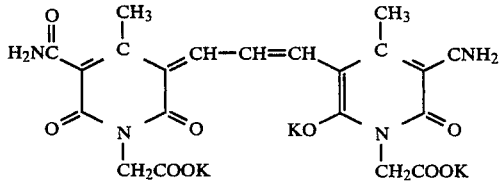
ExC-1
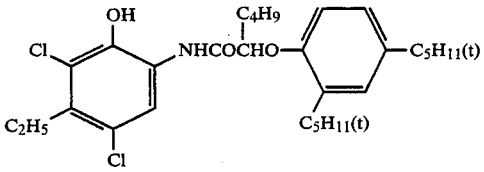
ExC-2
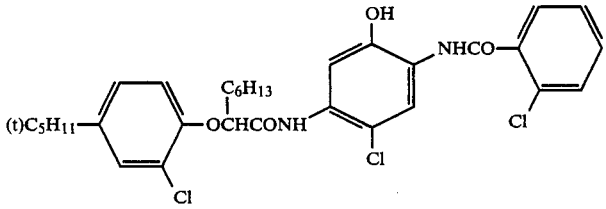
ExC-3
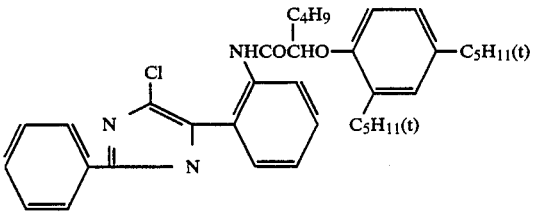

-continued

EXM-1

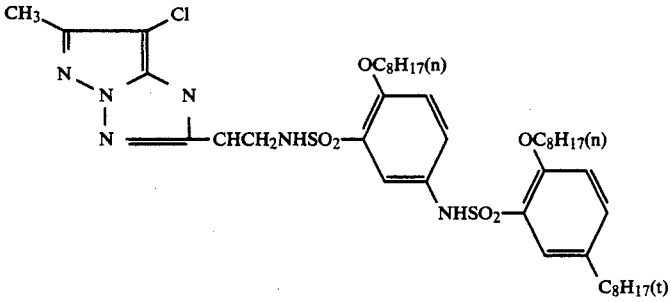

ExM-2

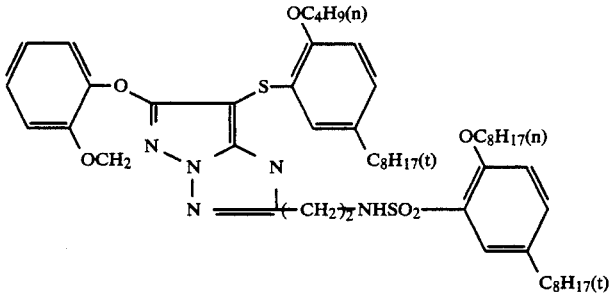

ExM-3

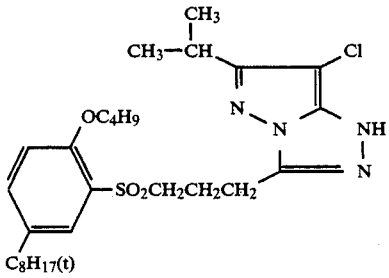

ExY-1

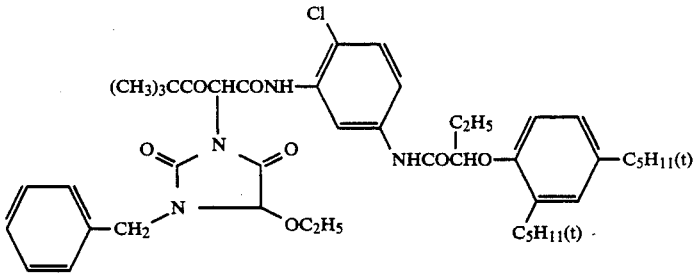

ExY-2

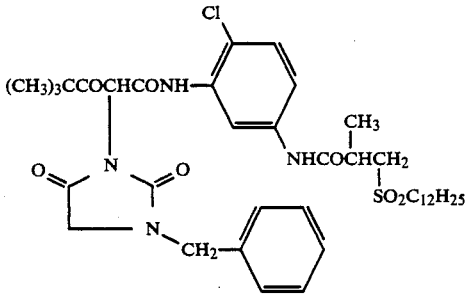

Solv-1: di(2-ethylhexyl) sebacate
Solv-2: trinonyl phosphate
Solv-3: di(3-methylhexyl) phthalate
Solv-4: tricresyl phosphate
Solv-5: dibutyl phthalate
Solv-6: trioctyl phosphate
Solv-7: di(2-ethylhexyl) phthalate H-1: 1,2-bis(vinylsulfonylacetamide)ethane
H-2: 4,6-dichloro-2-hydroxy-1,3,5-triazine sodium salt
ExZK-1: 7-(3-ethoxythiocarbonylaminobenzamide)-9-methyl-10- propargyl-1,2,3,4-tetrahydroacridinium trifluoromethane sulfonate
ExZK-2: 2[4-(3-[3-(3-[5-(3-[2-chloro-5-(1-dodecyloxycarbonylethoxycarbonyl)phenylcarbamoyl]-4-hydroxy-1-naphthylthio)- tetrazol-1-yl]phenyl-)ureido]benzenesulfonamide)phenyl]-1-formylhydrazine The above-prepared photosensitive material a of A-4 size was imagewise exposed before it was processed according to the following sequence of steps using a wet color copying machine, Model AP-5000 of Fuji Photo Film Co., Ltd., having built therein a developing apparatus having developing and bleach-fixing sections each of the structure shown in FIG. 1.

| Steps | Time | Temp. | Tank volume | Replenisher amount* |
|---|---|---|---|---|
| Color development | 135 sec. | 38° C. | 11 1 | 23 ml/sheet |
| Bleach-fix | 40 sec. | 33° C. | 3 1 | 20 ml/sheet |
| 1st washing | 40 sec. | 33° C. | 3 1 | — |
| 2nd washing | 40 sec. | 33° C. | 3 1 | 23 ml/sheet |
| Drying | 30 sec. | 80° C. | | |

*Replenisher amount is an amount of fresh solution added per A-4 size sheet of photosensitive material.

Washing water was replenished in a counterflow replenishment mode by adding water to the second washing tank and channeling the overflow from the second washing tank to the first washing tank. The amount of bleach-fix solution entrained with the photosensitive sheet from the bleach-fix tank to the first washing tank was 35 ml/m$^2$. Therefore the amount of washing water replenished was 9.1 times the amount of bleach-fix solution entrained.

The temperature of each processing solution was maintained at the indicated level during the experimental period by continuous temperature control.

Each processing solution had the following composition.

Color developing solution

| Ingredients | Mother | Replenisher |
|---|---|---|
| D-sorbitol | 0.15 g | 0.20 g |
| Sodium naphthalene sulfonate-formalin condensate | 0.15 g | 0.20 g |
| Ethylenediamine tetrakismethylene phosphonic acid | 1.5 g | 1.5 g |
| Diethylene glycol | 12.0 ml | 16.0 ml |
| Benzyl alcohol | 13.5 ml | 18.0 ml |
| Potassium bromide | 0.70 g | — |
| Benzotriazole | 0.003 g | 0.004 g |
| Sodium sulfite | 2.4 g | 3.2 g |
| N,N-bis(carboxymethyl)hydrazine | 4.0 g | 5.3 g |
| D-glucose | 2.0 g | 2.4 g |
| Triethanol amine | 6.0 g | 8.0 g |
| N-ethyl-N-(β-methanesulfonamidoethyl)-3-methyl-4-aminoaniline hydrogen sulfate | 6.4 g | 8.5 g |
| Potassium carbonate | 30.0 g | 25.0 g |
| Brightener (diaminostilbene) | 1.0 g | 1.2 g |
| Water totaling to | 1000 ml | 1000 ml |
| pH (25° C.) | 10.25 | 11.00 |

-continued

Bleach/fix solution

| Ingredients | Mother |
|---|---|
| Disodium ethylenediamine tetraacetate dihydrate | 2.0 g |
| Fe(III) ammonium ethylenediamine tetraacetate dihydrate | 70.0 g |
| Ammonium thiosulfate (700 g/l) | 180 ml |
| Sodium p-toluenesulfinate | 45.0 g |
| Sodium bisulfite | 35.0 g |
| 5-mercapto-1,3,4-triazole | 0.5 g |
| Ammonium nitrate | 10.0 g |
| Water totaling to | 1000 ml |
| pH (25° C.) | 6.10 |

The replenisher is the same as the mother solution.

Washing water

Replenisher was the same as mother water. Washing water was prepared by passing city water through a mixed bed column charged with an H type strong acid cation-exchange resin (Amberlite IR-120B manufactured by Rohm & Haas Co.) and an OH type anion-exchange resin (Amberlite IR-400 manufactured by Rohm & Haas Co.) to reduce the calcium and magnesium ion concentrations to 3 mg/liter or lower. To the water were added 20 mg/liter of sodium dichloroisocyanurate and 1.5 g/liter of sodium sulfate. The water had a pH in the range of 6.5 to 7.5.

In processing photosensitive sheets according to the above-mentioned procedure, the number of sheets processed, and operating openness K1 (=S1/V) and quiescent openness K2 (=S2/V) of the developing tank during operating and quiescent periods, respectively, were varied while the change of photographic property with time was observed. The results are shown in Table 1.

In this test, the bleach-fix tank was set at an operating openness K11 of 0.04 and a quiescent openness K22 of 0.004.

In Table 1, Comparative Example A having an operating openness K1 of 0.04 corresponds to a developing tank having no shutter assembly (neither a fixed nor a movable lid), Comparative Example B corresponds to a developing tank having only a fixed lid. In Examples of the invention, the developing tank was equipped with a shutter assembly of fixed and movable lids according to the present invention. Quiescent openness K2 was adjusted by the presence or absence of a seal in gaps along the sidewall.

The photographic property was evaluated in terms of a change ΔDmax (GL) of the maximum density of the green sensitive layer. A lowering of ΔDmax or an increase in magnitude of ΔDmax means occurrence of deterioration or oxidation of the developing solution.

TABLE 1

| | Amount of photosensitive material processed (sheet/week) | Openness (cm$^{-1}$) | | Δ $D_{max}$ with time (week) | | | | | |
|---|---|---|---|---|---|---|---|---|---|
| | | $K_1$ | $K_2$ | 1 | 2 | 4 | 6 | 8 | 10 |
| CE A | 150 | 0.04 | 0.04 | 0 | 0 | −0.02 | −0.04 | −0.07 | −0.14 |
| CE B | | 0.01 | 0.01 | 0 | 0 | 0 | −0.02 | −0.04 | −0.06 |
| E 1-1 | | 0.01 | 0.005 | 0 | 0 | 0 | 0 | −0.01 | −0.03 |
| E 1-2 | | 0.01 | 0.001 | 0 | 0 | 0 | 0 | 0 | −0.01 |
| CE A | 50 | 0.04 | 0.04 | 0 | −0.02 | −0.05 | −0.07 | −0.13 | −0.19 |
| CE B | | 0.01 | 0.01 | 0 | −0.01 | −0.03 | −0.06 | −0.11 | −0.16 |
| E 1-1 | | 0.01 | 0.005 | 0 | 0 | −0.01 | −0.02 | −0.05 | −0.09 |
| E 1-2 | | 0.01 | 0.001 | 0 | 0 | 0 | 0 | −0.02 | −0.04 |
| CE A | 15 | 0.04 | 0.04 | −0.01 | −0.03 | −0.07 | −0.14 | −0.23 | −0.39 |

TABLE 1-continued

| | | | | | | | | | |
|---|---|---|---|---|---|---|---|---|---|
| CE B | | 0.01 | 0.01 | 0 | −0.01 | −0.04 | −0.08 | −0.16 | −0.25 |
| E 1-1 | | 0.01 | 0.005 | 0 | 0 | −0.02 | −0.04 | −0.09 | −0.16 |
| E 1-2 | | 0.01 | 0.001 | 0 | 0 | −0.01 | −0.03 | −0.05 | −0.09 |
| CE A | 5 | 0.04 | 0.04 | −0.03 | −0.06 | −0.15 | −0.37 | −0.78 | −1.03 |
| CE B | | 0.01 | 0.01 | −0.01 | −0.03 | −0.08 | −0.16 | −0.32 | −0.75 |
| E 1-1 | | 0.01 | 0.005 | 0 | −0.01 | −0.04 | −0.07 | −0.13 | −0.28 |
| E 1-2 | | 0.01 | 0.001 | 0 | 0 | −0.02 | −0.04 | −0.06 | −0.09 |

The percent replacement of processing solution in each tank is defined by the equation:

$$\text{percent replacement} = \frac{\text{amount of replenisher added per week}}{\text{amount of processing solution in tank}} \times 100\%.$$

The percent replacement thus varies with the amount of photosensitive material processed as reported below.

| Amount of photsensitive material processed | Replacement |
|---|---|
| 150 sheets/week | 31% |
| 50 sheets/week | 10% |
| 15 sheets/week | 3.1% |
| 5 sheets/week | 0.4% |

An overall review of the data of Table 1 reveals that ΔDmax tends to lower as the amount of photosensitive material processed is smaller.

For the same number of photosensitive sheets processed per week, Comparative Examples, especially Comparative Example A having no lid induced a substantial lowering of ΔDmax whereas Examples of the invention induced a less lowering of ΔDmax, providing improved photographic property.

In Examples of the invention, a lower value of K2/K1 is effective in controlling the lowering of ΔDmax.

It is to be noted that the limit of maximum density lowering detectable with naked eyes is $\Delta Dmax > 0.1$. Therefore, no substantial difference is observable with $\Delta Dmax < 0.1$, only a slight difference is observable with $0.1 \leqq \Delta Dmax < 0.15$, and a difference is observable with $\Delta Dmax \geqq 0.15$.

Next, operating openness K11 and quiescent openness K22 of the bleach-fix tank during operating and quiescent periods, respectively, were varied while the deterioration of bleach-fix solution with time was determined. The results are shown in Table 2.

In this test, the developing tank was set at an operating openness K1 of 0.01 and a quiescent openness K2 of 0.001.

In Table 2, Comparative Example A having an operating openness K11 of 0.15 corresponds to a bleach-fix tank having no shutter assembly (neither a fixed nor a movable lid), Comparative Example B corresponds to a bleach-fix tank having only a fixed lid. In Examples of the invention, the bleach-fix tank was equipped with a shutter assembly of fixed and movable lids according to the present invention. Quiescent openness K22 was adjusted by the presence or absence of a seal in gaps along the sidewall.

The deterioration of beach-fix solution was evaluated by observing formation of deposits according to the following rating.

TABLE 2

| | Processing amount (sheet/week) | Openness (/cm) K11 | K22 | Deposit formation with time (week) 1 | 2 | 4 | 6 | 8 |
|---|---|---|---|---|---|---|---|---|
| CE A | 15 | 0.15 | 0.15 | O | O | Δ-X | XX | — |
| CE B | 15 | 0.04 | 0.04 | O | O | O | Δ | X-XX |
| E 1-1 | 15 | 0.04 | 0.02 | O | O | O | O | Δ |

TABLE 2-continued

| | Processing amount (sheet/week) | Openness (/cm) K11 | K22 | Deposit formation with time (week) 1 | 2 | 4 | 6 | 8 |
|---|---|---|---|---|---|---|---|---|
| E 1-2 | 15 | 0.04 | 0.004 | O | O | O | O | O |

*15 sheets per week of photosensitive material processed corresponds to a replacement rate of 10%.
O: no deposits
Δ: slight deposits
X: deposits
XX: filter clogging deposits As seen from Table 2, the controlled settings of openness in examples of the present invention are fully effective to retard formation of deposits, indicating less deterioration of the bleach-fix solution.

Example 2

Photosensitive material b, negative color photographic paper, was prepared as follows.

Preparation of photosensitive material b

Color photographic paper was prepared from a paper support having both sides laminated with polyethylene by coating the support with the following layers. Coating compositions were prepared as follows.

A coating composition for a first layer was prepared by dissolving 19.1 g of a yellow coupler, ExY-1 and 4.4 g of an image stabilizer, Cpd-1 in 27.2 cc of ethyl acetate and 7.7 cc (8.0 g) of a high-boiling solvent, Solv-1. The resulting solution was dispersed and emulsified in 185 cc of 10% gelatin aqueous solution containing 8 cc of 10% sodium dodecylbenzene sulfonate. This emulsified dispersion was combined with emulsions EM7 and EM8 by mixing and adjusted for the gelatin concentration, obtaining the first layer coating composition.

Coating compositions for second to seventh layers were prepared by substantially the same procedure as for the first layer coating composition. The gelatin hardener used in each layer was 1-oxy-3,5-dichloro-s-triazine sodium salt. The thickener used was Cpd-2.

For each layer, ingredients and their amounts coated are shown below. The amount of each ingredient coated is expressed in gram per square meter ($g/m^2$) unit except that the amount of silver halide coated is expressed by calculating the amount of silver coated.

| Support: Polyethylene laminated paper with the polyethylene layer on its 1st layer side containing a $TiO_2$ white pigment and a blue-tinting dye | |
|---|---|
| 1st layer: blue sensitive layer | |
| Monodispersed silver chloride emulsion (EM 7) spectrally sensitized with sensitizing dye ExS-1 | 0.15 |
| Monodispersed silver chloride emulsion (EM 8) spectrally sensitized with sensitizing dye ExS-1 | 0.15 |
| Gelatin | 1.86 |
| Yellow coupler, ExY-1 | 0.82 |
| Image stabilizer, Cpd-2 | 0.19 |
| Solvent, Solv-1 | 0.35 |
| 2nd layer: color mixing preventing layer | |
| Gelatin | 0.99 |
| Anti-color-mixing agent, Cpd-3 | 0.08 |
| 3rd layer: green sensitive layer | |
| Monodispersed silver chloride emulsion (EM 9) spectrally sensitized with sensitizing dyes ExS-2 and ExS-3 | 0.12 |
| Monodispersed silver chloride emulsion (EM 10) spectrally sensitized with sensitizing dyes ExS-2 and ExS-3 | 0.24 |
| Gelatin | 1.24 |
| Magenta coupler, ExM-1 | 0.39 |
| Image stabilizer, Cpd-4 | 0.25 |
| Image stabilizer, Cpd-5 | 0.12 |
| Solvent, Solv-2 | 0.25 |
| 4th layer: UV absorbing layer | |
| Gelatin | 1.60 |
| UV absorbers, Cpd-6/Cpd-7/Cpd-8 = 3/2/6 in weight ratio | 0.70 |
| Anti-color-mixing agent, Cpd-9 | 0.05 |
| Solvent, Solv-3 | 0.42 |
| 5th layer: red sensitive layer | |
| Monodispersed silver chloride emulsion (EM 11) spectrally sensitized with sensitizing dyes ExS-4 and ExS-5 | 0.07 |
| Monodispersed silver chloride emulsion (EM 12) spectrally sensitized with sensitizing dyes ExS-4 and ExS-5 | 0.16 |
| Gelatin | 0.92 |
| Cyan coupler, ExC-1 | 1.46 |
| Cyan coupler, ExC-2 | 1.84 |
| Image stabilizer, Cpd-7/Cpd-8/Cpd-10 = 3/4/2 in weight ratio | 0.17 |
| Dispersing polymer, Cpd-11 | 0.14 |
| Solvent, Solv-1 | 0.20 |
| 6th layer: UV absorbing layer | |
| Gelatin | 0.54 |
| UV absorbers, Cpd-6/Cpd-8/Cpd-10 = 1/5/3 in weight ratio | 0.21 |
| Solvent, Solv-4 | 0.08 |
| 7th layer: protective layer | |
| Gelatin | 1.33 |
| Acryl-modified copolymer of polyvinyl alcohol having degree of modification 17% | 0.17 |
| Liquid paraffin | 0.03 |

Anti-irradiation dyes Cpd-12 and Cpd-13 were also used. Each layer contained Alkanol XC (manufactured by E. I. duPont) and sodium alkylbenzene sulfonate as emulsification dispersion aids, and succinate ester and Magefac F-120 (manufactured by Dai-Nihon Ink K.K.) as coating aids. Stabilizers Cpd-14 and Cpd-15 were used to stabilize silver halide.

The emulsions used had the following characteristics.

| Emulsions | | | |
|---|---|---|---|
| Type | Shape | Particle size (μm) | Coefficient of variation |
| EM 7 | cubic | 1.1 | 0.10 |
| EM 8 | cubic | 0.8 | 0.10 |
| EM 9 | cubic | 0.45 | 0.09 |
| EM 10 | cubic | 0.34 | 0.09 |
| EM 11 | cubic | 0.45 | 0.09 |
| EM 12 | cubic | 0.34 | 0.10 |

*Coefficient of variation represents grain distribution and is defined as standard deviation divided by average particle size.

The compounds used in this example are identified by the following structural formulae.

ExY-1

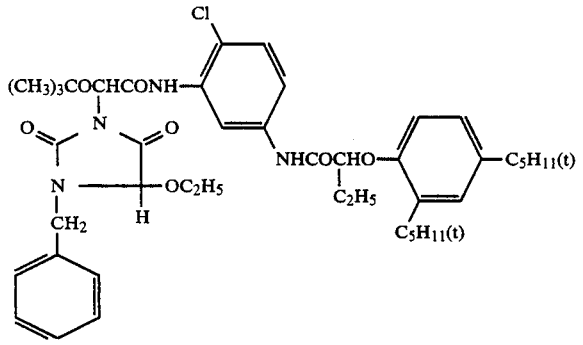

-continued
ExM-1
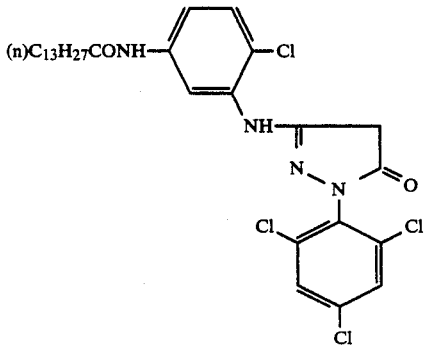
ExC-1
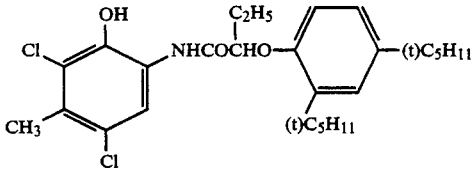
ExC-2
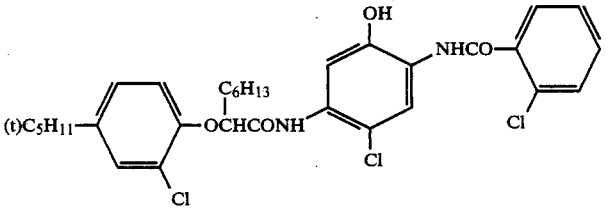
ExS-1
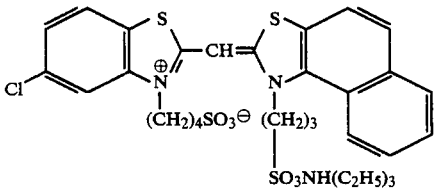
ExS-2
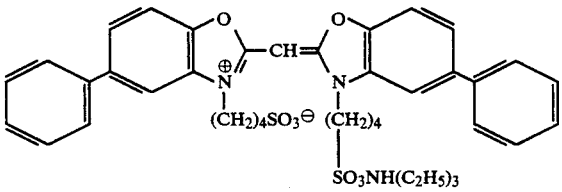
ExS-3
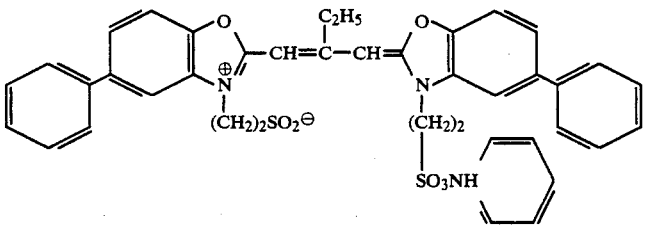
ExS-4
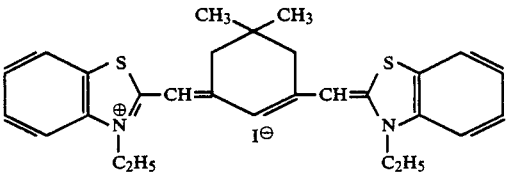

-continued
ExS-5
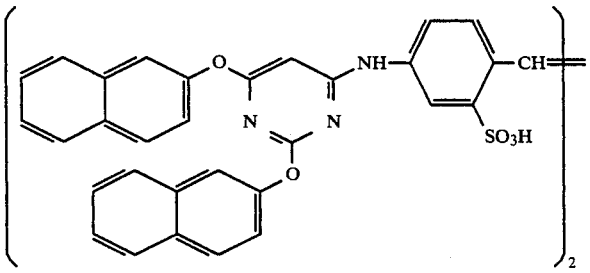
Cpd-1
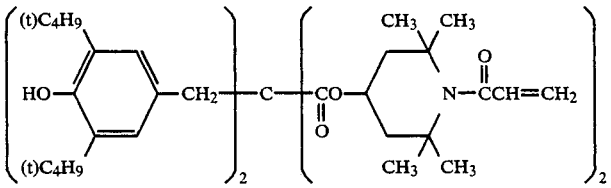
Cpd-2
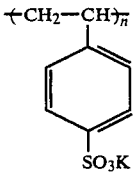
Cpd-3
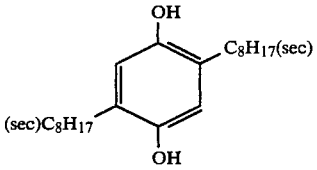
Cpd-4
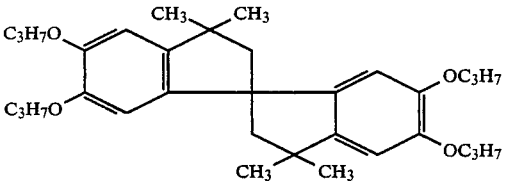
Cpd-5
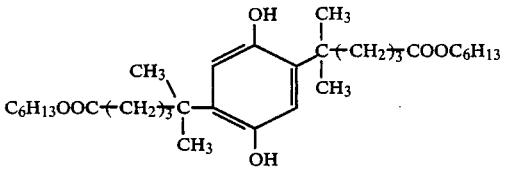
Cpd-6
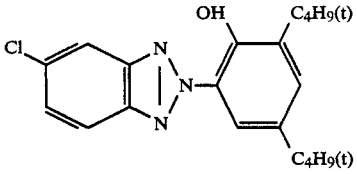
Cpd-7
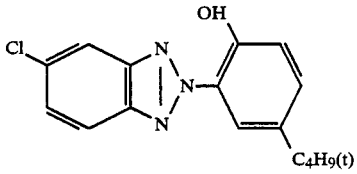

-continued

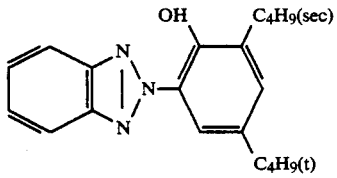

Cpd-8

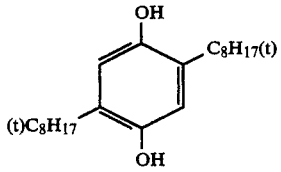

Cpd-9

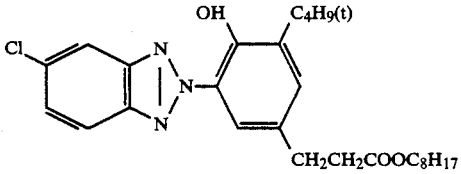

Cpd-10

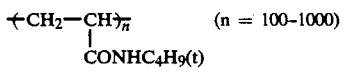

Cpd-11

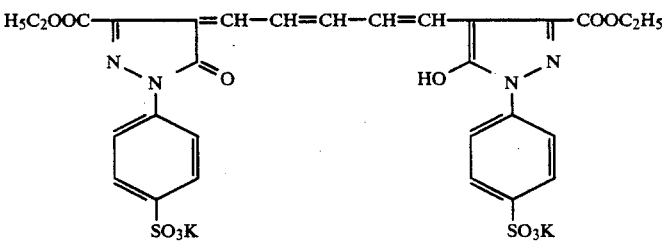

Cpd-12

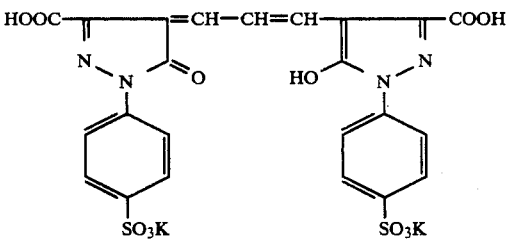

Cpd-13

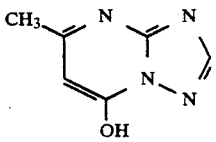

Cpd-14

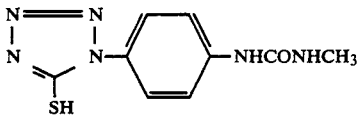

Cpd-15

Solv-1: dibutyl phthalate
Solv-2: trioctyl phosphate
Solv-3: trinonyl phosphate
Solv-4: tricresyl phosphate The above-prepared photosensitive material b of A-4 size was imagewise exposed before it was processed according to the following sequence of steps using a small size developing machine, Model FPRP-115 of Fuji Photo Film Co., Ltd., having built therein a developing apparatus having developing and bleach-fixing sections each of the structure shown in FIG. 1.

| Steps | Time | Temp. | Tank volume | Replenisher amount* |
|---|---|---|---|---|
| Color development | 45 sec. | 35° C. | 3 l | 200 ml/m$^2$ |
| Bleach-fix | 45 sec. | 30–36° C. | 3 l | 215 ml/m$^2$ |
| 1st washing | 30 sec. | 30–37° C. | 2 l | — |
| 2nd washing | 30 sec. | 30–37° C. | 2 l | — |

-continued

| Steps | Time | Temp. | Tank volume | Replenisher amount* |
|---|---|---|---|---|
| 3rd washing | 30 sec. | 30–37° C. | 2 l | 248 ml/m$^2$ |
| Drying | 60 sec. | 70–80° C. | | |

*Replenisher amount is an amount of fresh solution added per square meter of the emulsion surface of the photosensitive sheet.

Washing water was replenished in a counterflow replenishment mode by adding water to the third washing tank, channeling the overflow from the third washing tank to the second washing tank, and further channeling the overflow from the second washing tank to the first washing tank. The temperature of each processing solution was maintained at the indicated level during the experimental period by continuous temperature control.

Each processing solution had the following composition.

| Color developing solution | | |
|---|---|---|
| Ingredients | Mother | Replenisher |
| Water | 800 ml | 800 ml |
| Ethylenediamine-N,N,N,N-tetramethylene phosphonic acid | 1.5 g | 1.5 g |
| Triethylenediamine-(1,4-diazabicyclo(2,2,2)octane) | 5.0 g | 5.0 g |
| Sodium chloride | 1.4 g | — |
| Potassium carbonate | 25 g | 25 g |
| N-ethyl-N-(β-methanesulfonamidoethyl)-3-methyl-4-aminoaniline hydrogen sulfate | 5.0 g | 7.0 g |
| Diethylhydroxylamine | 4.2 g | 6.0 g |
| Brightener (4,4'-diaminostilbene) | 2.0 g | 2.5 g |
| Water totaling to | 1000 ml | 1000 ml |
| pH (25° C.) | 10.05 | 10.45 |

| Bleach/fix solution | |
|---|---|
| Ingredients | Mother |
| Water | 400 ml |
| Ammonium thiosulfate (70%) | 100 ml |
| Sodium bisulfite | 17 g |
| Fe(III) ammonium ethylenediamine tetraacetate | 55 g |
| Disodium ethylenediamine tetraacetate | 5 g |
| Ammonium bromide | 40 g |
| Glacial acetic acid | 9 g |
| Water totaling to | 1000 ml |
| pH (25° C.) | 5.40 |

The replenisher is the same as the mother solution.

Washing water

Replenisher was the same as mother water. Washing water used was deionized water at pH 6–8.5 having both calcium and magnesium contents reduced to 3 ppm or lower.

In processing photosensitive sheets according to the above-mentioned procedure, operating openness K1 (=S1/V) and quiescent openness K2 (=S2/V) of the developing tank during operating and quiescent periods, respectively, were varied while the change of photographic property with time was observed. The results are shown in Table 3.

In this test, the bleach-fix tank was set at an operating openness K11 of 0.04 and a quiescent openness K22 of 0.004.

In Table 3, Comparative Example A having an operating openness K1 of 0.16 corresponds to a developing tank having no shutter assembly (neither a fixed nor a movable lid), Comparative Example B corresponds to a developing tank having only a fixed lid. In Examples of the invention, the developing tank was equipped with a shutter assembly of fixed and movable lids according to the present invention. Quiescent openness K2 was adjusted by the presence or absence of a seal in gaps along the sidewall.

The photographic property was evaluated in terms of a change of sensitivity, delta-sensitivity (GL). Values of ΔlogE are reported in Table 3.

TABLE 3

| | Amount of photosensitive material processed (m$^2$/week) | Openness (cm$^{-1}$) K$_1$ | K$_2$ | Δ log E with time (week) 1 | 2 | 4 | 6 | 8 | 10 |
|---|---|---|---|---|---|---|---|---|---|
| CE A | 1.5 | 0.16 | 0.16 | 0 | −0.03 | −0.08 | −0.13 | −0.19 | −0.36 |
| CE B | (replacement | 0.04 | 0.04 | 0 | −0.01 | −0.04 | −0.08 | −0.12 | −0.16 |
| E 2-1 | rate = 10%) | 0.04 | 0.02 | 0 | 0 | −0.01 | −0.03 | −0.06 | −0.09 |
| E 2-1 | | 0.04 | 0.004 | 0 | 0 | −0.01 | −0.02 | −0.04 | −0.06 |

As seen from Table 3, the controlled settings of openness in examples of the present invention are fully effective to reduce a lowering of delta-sensitivity, indicating improved photographic property as well as the results of Example 1.

Example 3

A model experiment was carried out. A processing tank was provided with an adjustable shutter assembly such that the open area (surface area S of processing solution in contact with ambient air) was variable. The tank was charged with a processing solution of the following composition in a volume V of 1 liter. The solution was allowed to stand in the tank at room temperature for 1, 2 and 4 weeks. Solution deterioration was determined relative to openness (S/V). This openness is a quiescent openness as understood from the experimental conditions. The results are plotted in FIG. 7.

| Composition of processing solution | |
|---|---|
| $K_2CO_3$ | 25 g |
| Hydroxylamine hydrogen sulfate (HAS) | 3.5 g |
| Sodium sulfite (SS) | 2.0 g |
| Water totaling to | 1000 ml |

The amounts of HAS and SS remaining in the processing solution were determined as selected ratings on deterioration of the solution.

Figure 7:
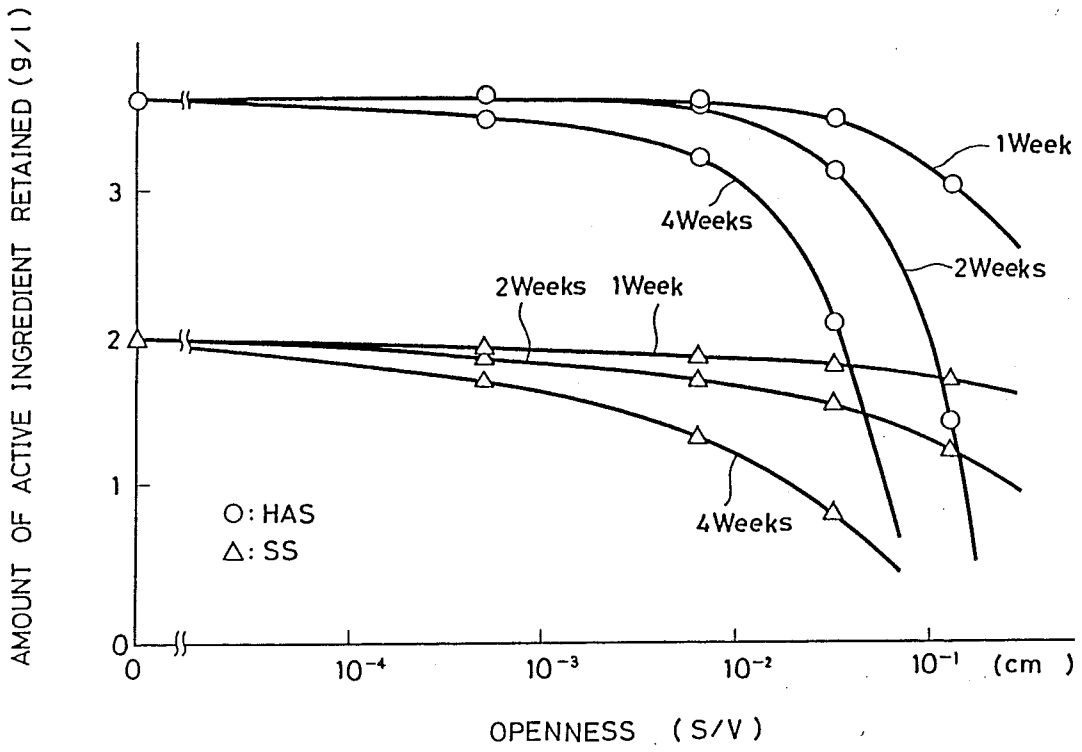
FIG. 7 is a diagram in which the amount of remaining active ingredients indicative of solution deterioration is plotted as a function of openness in Example 3.

As seen from FIG. 7, the processing solution is less deteriorated as the (quiescent) openness is reduced. Particularly with an openness of $10^{-2}$/cm or less, the processing solution deteriorated little over the period of 4 weeks without replenishment.

The results of this model experiment account for the results of Examples 1 and 2.

Additionally, the deterioration of developing solution in a practical machine in Example 1 or 2 was compared with the deterioration of developing solution in a model tank as used in Example 3. It was found that K1 and K2 calculated from geometrical dimensions of the practical machine and the deterioration well corresponded to the results of the model experiment.

In the photosensitive material processing apparatus of the present invention, the openness (defined as the surface area of processing solution in contact with the surrounding air divided by the volume of solution) is controlled to the predetermined range both during operating and quiescent periods. In one form, openness control is accomplished by movement of a movable lid relative to a fixed lid such that an inlet and an outlet for photosensitive material are shut off to sealingly shield the solution surface except the operating period. Sealing coverage of the solution surface is effective in preventing evaporation, temperature drop, deterioration and property changes of the processing solution.

Even the rate of replacement of processing solution is low, the solution in the tank can be maintained under useful conditions over a prolonged period of time. For occasional operation, the invention mitigates a manual operation of periodic replacement of processing solution which is otherwise required to provide an effective processing solution, and thus reduces the amount of processing solution consumed.

In a preferred form, anti-stick means is provided to prevent the movable lid from sticking to the fixed lid, ensuring that the movable lid or solution surface shutter assembly is always operated smoothly.

We claim:

1. A photosensitive material processing apparatus adaptable for occasional operation, comprising a processing tank which has an opening at the top and is filled with processing solution, and means for controlling access to said processing tank through its opening such that the openness S/V during photosensitive material processing periods is in the range of from $1\times10^{-4}$ to $1\times10^{-1}$/cm and the openness S/V during quiescent periods is up to 70% of the openness S/V during photosensitive material processing periods wherein V is the volume of the processing solution in the tank and S is the area of a portion of the processing solution surface which is open to the ambient atmosphere.

2. The apparatus of claim 1, wherein said means for controlling access is operable during occasional operation when a volume of replenishment processing solution added to said tank each week is less than said volume of processing solution in said tank.

3. An apparatus adaptable for the occasional processing of a photosensitive material by dipping it in processing solution, comprising a processing tank which has an opening at the top and is filled with the processing solution, a fixed lid attached to the tank opening and including an inlet and an outlet through which the photosensitive material can be delivered into and out of the tank and hence the processing solution, a movable lid mounted for relative motion to said fixed lid to open and close the inlet and the outlet, and drive means for moving said movable lid.

4. An apparatus for processing a photosensitive material by dipping it in processing solution, comprising a processing tank which has an opening at the top and is filled with the processing solution, a fixed lid attached to the tank opening and including an inlet and an outlet through which the photosensitive material can be delivered into and out of the tank and hence the processing solution, a movable lid mounted for relative motion to said fixed lid to open and close the inlet and the outlet, drive means for moving said movable lid, and means disposed between the fixed and movable lids for preventing the movable lid from sticking to the fixed lid.

5. The apparatus of claim 4 which is adaptable for occasional operation.

6. The apparatus of claim 3, 4 or 5 wherein said drive means operates such that the inlet and the outlet are opened when the photosensitive material is carried into and out of the tank, and the inlet and the outlet are closed during quiescent periods.

7. A process for controlling deterioration and evaporation of a volume of photographic processing solution in a tank having a fixed lid with an inlet opening and an outlet opening for the introduction and removing of photosensitive material and a movement lid to open and close said openings, comprising:

replenishing small amounts of fresh processing solution to said tank after each processing operation, and moving said movable lid to close said openings after each processing operation when the total amount of fresh processing solution added to said tank each week is less than said volume of processing solution in said tank.

* * * * *